US007896627B2

(12) United States Patent
Okamoto et al.

(10) Patent No.: US 7,896,627 B2
(45) Date of Patent: Mar. 1, 2011

(54) ROTARY TYPE EXPANDER AND FLUID MACHINERY

(75) Inventors: Masakazu Okamoto, Osaka (JP); Michio Moriwaki, Osaka (JP); Eiji Kumakura, Osaka (JP); Tetsuya Okamoto, Osaka (JP); Katsumi Sakitani, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/570,878

(22) PCT Filed: Sep. 3, 2004

(86) PCT No.: PCT/JP2004/012836

§ 371 (c)(1),
(2), (4) Date: Mar. 7, 2006

(87) PCT Pub. No.: WO2005/026499

PCT Pub. Date: Mar. 24, 2005

(65) Prior Publication Data

US 2007/0053782 A1 Mar. 8, 2007

(30) Foreign Application Priority Data

Sep. 8, 2003 (JP) ..... 2003-315179
Mar. 1, 2004 (JP) ..... 2004-056741

(51) Int. Cl.
*F01C 1/30* (2006.01)

(52) U.S. Cl. ..... 418/13; 418/60

(58) Field of Classification Search ..... 418/5, 418/11, 12, 13, 15, 58, 60, 62, 63, 66, 67, 418/251, 261, 180, 181, 210, 215, 216, 241, 418/112, 118, 125, 148
See application file for complete search history.

(56) References Cited

U.S. PATENT DOCUMENTS 2,691,482 A * 10/1954 Ungar ..... 418/1

(Continued)

FOREIGN PATENT DOCUMENTS

JP 54-037248 A 11/1979

(Continued)

OTHER PUBLICATIONS

Microfilm of the specificaiton and drawings annexed to the request of Japanese Utility Model Application No. 39762/1982 (Laid-open No. 142301/1983), Sep. 26, 1983.

*Primary Examiner*—Thomas Denion
*Assistant Examiner*—Douglas J. Duff
(74) *Attorney, Agent, or Firm*—Birch, Stewart, Kolasch & Birch, LLP

(57) ABSTRACT

A rotary type expander is provided with two rotary mechanism parts which differ from each other in displacement volume. The outflow side of the first rotary mechanism part of small displacement volume is fluidly connected to the inflow side of the second rotary mechanism part of large displacement volume. The processes by which the volume of a first low-pressure chamber in the first rotary mechanism part decreases and the volume of a second high-pressure chamber in the second rotary mechanism part increases are respectively in sync. Refrigerant at high pressure is first introduced into a first high-pressure chamber of the first rotary mechanism part. Thereafter, this high-pressure refrigerant passes through a communicating passage and then flows by way of the first low-pressure chamber into the second high-pressure chamber while expanding. The after-expansion refrigerant flows out to an outflow port from a second low-pressure chamber of the second rotary mechanism part.

15 Claims, 14 Drawing Sheets

U.S. PATENT DOCUMENTS

| | | | | |
|---|---|---|---|---|
| 4,025,224 | A | 5/1977 | Starbard | |
| 5,152,156 | A * | 10/1992 | Tokairin | 62/498 |
| 5,314,318 | A * | 5/1994 | Hata et al. | 418/60 |
| 5,322,424 | A * | 6/1994 | Fujio | 418/11 |
| 5,775,882 | A * | 7/1998 | Kiyokawa et al. | 417/310 |
| 5,775,883 | A * | 7/1998 | Hattori et al. | 417/310 |
| 6,102,677 | A * | 8/2000 | Iida et al. | 417/463 |
| 6,290,472 | B2 * | 9/2001 | Gannaway | 417/371 |
| 6,860,724 | B2 * | 3/2005 | Cho et al. | 417/218 |
| 6,910,872 | B2 * | 6/2005 | Cho et al. | 418/60 |
| 6,929,455 | B2 * | 8/2005 | Dreiman et al. | 417/410.3 |
| 7,128,540 | B2 * | 10/2006 | Tadano et al. | 417/410.3 |
| 7,186,100 | B2 * | 3/2007 | Cho et al. | 418/94 |
| 7,201,567 | B2 * | 4/2007 | Wiertz et al. | 417/410.5 |

FOREIGN PATENT DOCUMENTS

| | | | |
|---|---|---|---|
| JP | 54-37248 | B2 | 11/1979 |
| JP | 57-068507 | A | 4/1982 |
| JP | 58-142301 | U | 9/1983 |
| JP | 59-052343 | B2 | 12/1984 |
| JP | 62-218680 | A | 9/1987 |
| JP | 64-11384 | U | 1/1989 |
| JP | 1-277695 | A | 11/1989 |
| JP | 5-133366 | A | 5/1993 |
| JP | 8-151989 | A | 6/1996 |
| JP | 11-241693 | A | 9/1999 |
| JP | 2000-234814 | A | 8/2000 |
| JP | 2003-138901 | A | 5/2003 |

* cited by examiner

ROTARY TYPE EXPANDER AND FLUID MACHINERY

TECHNICAL FIELD

The present invention relates to an expander for power generation by expansion of high-pressure fluid, and to a fluid machine employing such an expander.

BACKGROUND ART

Hitherto, so-called rotary type fluid machines have been known in the art. Rotary type fluid machines are now widely used as compressors for refrigerant compression in refrigeration apparatus. On the other hand, JP, 2000-234814, A, patent gazette discloses a refrigeration apparatus. In this refrigeration apparatus, an expander serving as an expansion mechanism is provided in a refrigerant circuit and power is recovered from refrigerant which is a supercritical-state, high-pressure fluid. The above-described rotary type fluid machine may be used as an expander for power recovery. In this case, high-pressure fluid is introduced into the rotary type fluid machine servings as an expander and power is obtained by expansion of the high-pressure fluid. Power recovered by the expander is utilized to drive a compressor.

The operation of a rotary type fluid machine as an expander (i.e. a rotary type expander) is described. In a typical rotary type expander, the volume of an expansion chamber varies with the rotation of a rotating shaft. From the point of time when the volume of the expansion chamber decreases to a minimum, introduction of high-pressure fluid into the expansion chamber commences. Such high-pressure fluid introduction into the expansion chamber is terminated at the point of time when the rotational angle of the rotating shaft reaches a predetermined value. And, thereafter, the refrigerant expands within the expansion chamber which is hermetically closed, whereby the rotating shaft is rotated by refrigerant expansion. In other words, within a single rotation of the rotating shaft in the rotary type expander, there are two different periods, during one of which there is high-pressure fluid flow into the expansion chamber and during the other of which there is no high-pressure fluid flow into the expansion chamber.

PROBLEMS THAT THE INVENTION INTENDS TO SOLVE

As described above, in the aforesaid rotary type expander, high-pressure fluid is intermittently introduced into the expansion chamber. In addition, flow of high-pressure fluid, which is towards the expansion chamber, is interrupted in the course of a process of increasing the volume of the expansion chamber. In other words, flow of high-pressure fluid towards the expansion chamber is interrupted when its flow velocity is being relatively high. This produces a problem, that is, pulsation of fluid occurs in a pipe conduit in fluid communication with the rotary type expander, which is a cause for vibration and noise. Especially, if supercritical-state high-pressure fluid in liquid form is introduced into a rotary type expander, this causes a water hammer phenomenon because that high-pressure fluid is an incompressible fluid. This gives rise to problems such as excessive vibration and noise and, in some cases, causes damage to the piping et cetera.

With the above-described problems in mind, the present invention was made. Accordingly, an object of the present invention is to accomplish, in a rotary type expander which obtains power by expansion of high-pressure fluid as well as in a fluid machine provided with such a rotary type expander, improvement in their reliability by reducing vibration or the like caused by fluid pulsation

DISCLOSURE OF THE INVENTION

A first invention is intended to provide a rotary type expander comprising: a plurality of rotary mechanism parts (70, 80), each rotary mechanism part (70, 80) including a cylinder (71, 81) both ends of which are closed, a piston (75, 85) for forming a fluid chamber (72, 82) within the cylinder (71, 81), and a blade (76, 86) for dividing the fluid chamber (72, 82) into a high-pressure chamber (73, 83) of high-pressure side and a low-pressure chamber (74, 84) of low-pressure side; and a single rotating shaft (40) which is provided with an eccentric part (41, 42) for engagement with the piston (75, 85), the eccentric part (41, 42) being the same in number as the rotary mechanism part (70, 80). And the plural rotary mechanism parts (70, 80) have different displacement volumes from each other and are connected in series in ascending order of their displacement volumes, and in two of the plural rotary mechanism parts (70, 80) (i.e. a rotary mechanism part (70) of former stage side and a rotary mechanism part (80) of latter stage side which are fluidly connected together), fluid flows into the high-pressure chamber (83) of the latter-stage-side rotary mechanism part (80) from the low-pressure chamber (74) of the former-stage-side rotary mechanism part (70).

A second invention is intended to provide a rotary type expander comprising: a plurality of rotary mechanism parts (70, 80), each rotary mechanism part (70, 80) including a cylinder (71, 81) both ends of which are closed, a piston (75, 85) for forming a fluid chamber (72, 82) within the cylinder (71, 81), and a blade (76, 86) for dividing the fluid chamber (72, 82) into a high-pressure chamber (73, 83) of high-pressure side and a low-pressure chamber (74, 84) of low-pressure side; and a single rotating shaft (40) which is provided with an eccentric part (41, 42) for engagement with the piston (75, 85), the eccentric part (41, 42) being the same in number as the rotary mechanism part (70, 80). And the plural rotary mechanism parts (70, 80) have different displacement volumes from each other and are connected in series in ascending order of their displacement volumes, and in two of the plural rotary mechanism parts (70, 80) (i.e. a rotary mechanism part (70) of former stage side and a rotary mechanism part (80) of latter stage side which are fluidly connected together), the low-pressure chamber (74) of the former-stage-side rotary mechanism part (70) and the high-pressure chamber (83) of the latter-stage-side rotary mechanism part (80) are in fluid communication with each other, thereby forming a single expansion chamber (66).

A third invention provides a rotary type expander according to the rotary type expander of the first or second invention which is characterized in that the blades (76, 86) of the plural rotary mechanism parts (70, 80) are synchronized with each other with respect to the timing at which each blade (76, 86) reaches its most withdrawn position relative to the direction of the outer periphery of the cylinder (71, 81).

A fourth invention provides a rotary type expander according to the rotary type expander of any of the first to third inventions which is characterized in that the eccentric parts (41, 42) of the rotating shaft (40) are so formed as to differ from each other in eccentric direction.

A fifth invention provides a rotary type expander according to the rotary type expander of any of the first to third inventions which is characterized in that the eccentric parts (41, 42) of the rotating shaft (40) are formed such that their respective eccentric directions are at equiangular intervals.

A sixth invention provides a rotary type expander according to the rotary type expander of either the first invention or the second invention which is characterized in that: the cylinders (71, 78) of the rotary mechanism parts (70, 80) are stacked in layers with an intermediate plate (63) interposed therebetween; a communicating passage (64), for establishing in two adjacent rotary mechanism parts (70, 80) (i.e. a rotary mechanism part (70) of former stage side and a rotary mechanism part (80) of latter stage side) fluid communication between the low-pressure chamber (74) of the former-stage-side rotary mechanism part (70) and the high-pressure chamber (83) of the latter-stage-side rotary mechanism part (80), is so formed in each intermediate plate (63) as to extend therethrough in a thickness direction; and each cylinder (71, 81) is disposed in a postural position so that the length of the communicating passage (64) is minimized.

A seventh invention provides a rotary type expander according to the rotary type expander of any of the first to third inventions which is characterized in that: the cylinders (71, 78) of the rotary mechanism parts (70, 80) are stacked in layers with an intermediate plate (63) interposed therebetween; a communicating passage (64), for establishing in two adjacent rotary mechanism parts (70, 80) (i.e. a rotary mechanism part (70) of former stage side and a rotary mechanism part (80) of latter stage side) fluid communication between the low-pressure chamber (74) of the former-stage-side rotary mechanism part (70) and the high-pressure chamber (83) of the latter-stage-side rotary mechanism part (80), is so formed in each intermediate plate (63) as to extend therethrough in a thickness direction; and in order that the length of the communicating passage (64) may be minimized, the eccentric parts (41, 42) of the rotating shaft (40) differ from each other in eccentric direction by a predetermined angle.

An eighth invention provides a rotary type expander according to the rotary type expander of any of the first to third inventions which is characterized in that: in two of the plural rotary mechanism parts (70, 80) (i.e. a rotary mechanism part (70) of former stage side and a rotary mechanism part (80) of latter stage side) which are in fluid communication with each other, the low-pressure chamber (74) of the former-stage-side rotary mechanism part (70) and the high-pressure chamber (83) of the latter-stage-side rotary mechanism part (80) are in fluid communication with each other by way of a communicating passage (64); and an intermediate chamber (65) of predetermined volume for reducing pressure variation in the communicating passage (64) is disposed along the communicating passage (64).

A ninth invention provides a rotary type expander according to the rotary type expander of any of the first to eighth inventions which is characterized in that the blade (76, 86) is formed as a separate body from the piston (75, 85) and is supported advanceably/withdrawably on the cylinder (71, 81) with its tip pressed against the piston (75, 85).

A tenth invention provides a rotary type expander according to the rotary type expander of any of the first to eighth inventions which is characterized in that the blade (76, 86) is formed integrally with the piston (75, 85) so as to project from the side surface of the piston (75, 85) and is supported advanceably/withdrawably and rotatably on the cylinder (71, 81).

An eleventh invention provides a rotary type expander according to the rotary type expander of any of the first to tenth inventions which is characterized in that carbon dioxide at a pressure above its critical pressure is used as a fluid to be introduced into the high-pressure chamber (73) of the rotary mechanism part (70) of smallest displacement volume.

A twelfth invention is intended to provide a fluid machine which comprises a rotary type expander (60) of the first invention, a compressor (50) engaging a rotating shaft (40) of the rotary type expander (60), and a casing (31) which contains the rotary type expander (60) and the compressor (50), and in which fluid compressed in the compressor (50) is discharged into the casing (31). And, a plurality of rotary mechanism parts (70, 80) which are provided in the rotary type expander (60) are arranged such that the greater their displacement volume is, the farther their position is away from the compressor (50).

A thirteenth invention is intended to provide a fluid machine which comprises a rotary type expander (60) of the second invention, a compressor (50) engaging a rotating shaft (40) of the rotary type expander (60), and a casing (31) which contains the rotary type expander (60) and the compressor (50), and in which fluid compressed in the compressor (50) is discharged into the casing (31). And, a plurality of rotary mechanism parts (70, 80) which are provided in the rotary type expander (60) are arranged such that the greater their displacement volume is, the farther their position is away from the compressor (50).

A fourteenth invention provides a fluid machine according to the fluid machine of either the twelfth invention or the thirteenth invention which is characterized in that the blades (76, 86) of the plural rotary mechanism parts (70, 80) are synchronized with each other with respect to the timing at which each blade (76, 86) reaches its most withdrawn position relative to the direction of the outer periphery of the cylinder (71, 81).

A fifteenth invention provides a fluid machine according to the fluid machine of either the twelfth invention or the thirteenth invention which is characterized in that the rotary type expander (60) is provided with a heat insulating member (100) for inhibiting transfer of heat from fluid in the casing (31) to fluid passing through the rotary type expander (60).

Working Operation

In each of the first and second inventions, a plurality of rotary mechanism parts (70, 80) having different displacement volumes from each other are provided in a rotary type expander (60). These plural rotary mechanism parts (70, 80) are fluidly connected in series in ascending order of their displacement volumes. In other words, the outflow side of the former-stage-side rotary mechanism part (70) of small displacement volume is fluidly connected to the inflow side of the latter-stage-side rotary mechanism part (80) of large displacement volume.

In the rotary type expander (60) of this invention, high-pressure fluid is first introduced into the rotary mechanism part (70) of smallest displacement volume. More specifically, high-pressure fluid is introduced into the high-pressure side of the fluid chamber (72) in the rotary mechanism part (70), i.e. into the high-pressure chamber (73), and continues to flow into the high-pressure chamber (73) until the volume of the fluid chamber (72) increases to a maximum. In other words, high-pressure fluid keeps flowing into the high-pressure chamber (73) over a period of time from when the blade (77) reaches its most withdrawn position relative to the direction of the outer periphery of the cylinder (71) to when the rotating shaft (40) makes substantially one revolution.

Here, if the rotational angle of the rotating shaft (40) when the blade (77) is in its most withdrawn position relative to the direction of the outer periphery of the cylinder (71) is 0°, the rate, at which the volume of the high-pressure chamber (73) increases, becomes gradually higher in the rotational angle range from 0° up to 180°. On the other hand, the rate, at which the volume of the high-pressure chamber (73) increases, becomes gradually lower in the rotational angel range from 180° up to 360°. And, the flow velocity of fluid flowing into the high-pressure chamber (73) gradually increases in the rotational angle range of the rotating shaft (40) from 0° up to 180° while on the other hand it gradually decreases in the rotational angle range of the rotating shaft (40) from 180° up to 360°. Accordingly, at the point of time when flow of fluid towards the high-pressure chamber (73) is interrupted, the flow velocity of that fluid becomes almost zero.

Subsequently, the fluid chamber (72) filled up with high-pressure fluid becomes the low-pressure chamber (74) of low-pressure side and comes into fluid communication with the high-pressure chamber (83) of the latter-stage-side rotary mechanism part (80) of large displacement volume. The fluid within the low-pressure chamber (74) expands while flowing into the high-pressure chamber (83) of the latter-stage-side rotary mechanism part (80). In other words, in the second invention, fluid expands inside the expansion chamber (66) made up of the low-pressure chamber (74) of the former-stage-side rotary mechanism part (70) and the high-pressure chamber (83) of the latter-stage-side rotary mechanism part (80). The fluid sequentially repeatedly undergoes such expansion and is eventually fed out from the rotary mechanism part (80) of largest displacement volume. And, the rotating shaft (40) of the rotary type expander (60) is driven by such fluid expansion. Stated another way, the internal energy of high-pressure fluid introduced into the rotary type expander (60) is converted into power used to rotate the rotating shaft (40).

In each of the third and fourteenth inventions, in the rotary mechanism parts (70, 80), the blades (76, 86) are synchronized with each other with respect to the timing at which the blades (76, 86) reach their respective most withdrawn positions. At the point of time when the volume of the low-pressure chamber (74) increases to a maximum in the former-stage-side rotary mechanism part (70), the volume of the high-pressure chamber (83) decreases to a minimum in the latter-stage-side rotary mechanism part (80). When the volume of the low-pressure chamber (74) starts decreasing in the former-stage-side rotary mechanism part (70), the volume of the high-pressure chamber (83) concurrently starts increasing in the latter-stage-side rotary mechanism part (80). And, at the point of time when the volume of the low-pressure chamber (74) decreases to a minimum in the former-stage-side rotary mechanism part (70), the volume of the high-pressure chamber (83) increases to a maximum in the latter-stage-side rotary mechanism part (80).

In each of the fourth and fifth inventions, it is arranged such that the eccentric parts (41, 42) of the rotating shaft (40) are formed, such that they are off-centered in different directions from each other. As a result of such arrangement, forces, applied by way of the pistons (75, 85) to the rotating shaft (40) from fluids within the high-pressure chambers (73, 83) of the rotary mechanism parts (70, 80), differ from each other in direction of action.

Furthermore, in the fifth invention, the eccentric directions of the eccentric parts (41, 42) in the rotating shaft (40) deviate at constant angular intervals. For example, in the case where the rotating shaft (40) is provided with two eccentric parts (41, 42), their eccentric directions are at 180° intervals. If provided with three eccentric parts (41, 42), their eccentric directions are at 120° intervals. And, in regard to forces applied to the rotating shaft (40) from fluids within the high-pressure chambers (73, 83) of the rotary mechanism parts (70, 80), their action directions are at substantially constant angular intervals.

In each of the sixth and seventh inventions, the communicating passage (64) is formed in the intermediate plate (63). This communicating passage (64) establishes fluid communication between the low-pressure chamber (74) of the former-stage-side rotary mechanism part (70) and the high-pressure chamber (83) of the latter-stage-side rotary mechanism part (80). The high-pressure chamber (83) is formed on the left side of the blade (86) in the latter-stage-side rotary mechanism part (80), provided that the low-pressure chamber (74) is formed on the right side of the blade (77) in the former-stage-side rotary mechanism part (70). And, if the angle at which each cylinder (71, 81) is arranged is deviated so that the opening position of the communicating passage (64) on the low-pressure chamber's (74) side and the opening position of the communicating passage (64) on the high-pressure chamber's (83) side substantially overlap each other, the angle formed by the direction in which the communicating passage (64) extends and the thickness direction of the intermediate plate (63) is reduced to a minimum, and the length of the communicating passage (64) is minimized.

In the eighth invention, the intermediate chamber (65) is provided along the communicating passage (64). The intermediate chamber (65) is formed such that it has a certain chamber volume size capable of reducing pressure variation in the communicating passage (64). And, fluid exiting the low-pressure chamber (74) of the former-stage-side rotary mechanism part (70) flows, through the communicating passage (64) and then through the intermediate chamber (65), into the high-pressure chamber (83) of the latter-stage-side rotary mechanism part (80).

In the ninth invention, in each rotary mechanism part (70, 80), the blade (76, 86) is formed as a separate body from the piston (75, 85). With its tip pressed against the piston (75, 85), the blade (76, 86) advances or withdraws in association with the eccentric motion of the piston (75, 85). That is to say, in this invention, each rotary mechanism part (70, 80) is of so-called rolling piston type.

In the tenth invention, in each rotary mechanism part (70, 80), the blade (76, 86) is formed integrally with the piston (75, 85). The blade (76, 86) is supported advanceably/withdrawably and rotatably on the cylinder (71, 81). The piston (75, 85) integral with the blade (76, 86) engages the eccentric part (41, 42) of the rotating shaft (40) and, at the same time, oscillates within the cylinder (71, 81). In other words, in this invention, each rotary mechanism part (70, 80) is of so-called swinging piston type.

In the eleventh invention, in the smallest in displacement volume of the plural rotary mechanism parts (70, 80), its high-pressure chamber (73) is supplied with carbon dioxide ($CO_2$). Carbon oxide to be introduced into the high-pressure chamber (73) is at a pressure above its critical pressure. And, carbon oxide introduced into the high-pressure chamber (73) expands while passing in sequence through the plural serially-connected rotary mechanism parts (70, 80).

In the twelfth invention, on the one hand, the rotary type expander (60) of the first invention and the compressor (50) are housed within the casing (31). In the thirteenth invention, on the other hand, the rotary type expander (60) of the second invention and the compressor (50) are housed within the casing (31). In these inventions, the compressor (50) is in engagement with the rotating shaft (40) of the rotary type expander (60). The compressor (50) is driven using power obtained in the rotary type expander (60), draws in fluid for compression thereof. The fluid compressed in the compressor (50) is discharged to a space within the casing (31) and, after the passage through the space, is delivered to outside the casing (31). Note that the compressor (50) is not necessarily driven by the rotary type expander (60) alone. The compressor (50) may be driven for example by both the electric motor and the rotary type expander (60).

In the rotary type expander (60) of each of the twelfth and thirteenth inventions, the plural rotary mechanism parts (70, 80) are arranged such that the greater their displacement volume is, the farther their position is away from the compressor (50). Here, as fluid passing through the rotary type expander (60) decreases in pressure due to expansion, its temperature likewise decreases. On the other hand, fluid introduced into the rotary type expander (60) passes in sequence from the rotary mechanism part (70) of small displacement volume to the rotary mechanism part (80) of large displacement volume. Consequently, in the rotary type expander (60), the greater the displacement volume of the rotary mechanism part (80) is, the lower the temperature of fluid passing therethrough becomes. And, in this invention, the lower the temperature of passing fluid is, the farther the rotary mechanism part (80) is positioned away from the compressor (50) which discharges high-temperature/high-pressure fluid.

In the fifteenth invention, the rotary type expander (60) is provided with the heat insulating member (100). Generally, fluid passing through the rotary type expander (60) has a temperature lower than that of fluid compressed in the compressor (50) and then discharged into the casing (31), and is heated to some extent by heat transfer from the fluid discharged out of the compressor (50). The heat insulating member (100) is provided to inhibit heat transfer from fluid discharged from the compressor (50) to fluid passing through the rotary type expander (60), thereby reducing the amount of heat which is applied to fluid passing through the rotary type expander (60).

Effects

In the rotary type expander (60) of the present invention, high-pressure fluid supplied thereto is first introduced into the high-pressure chamber (73) of the rotary mechanism part (70) of smallest displacement volume. And, the flow velocity of the fluid towards the high-pressure chamber (73) gradually increases or decreases depending on the volume variation rate of the high-pressure chamber (73).

Here, in a conventional rotary type expander (60), flow of fluid to be introduced is interrupted when its flow velocity is being relatively high, in association with which there occurs an abrupt variation in pressure. On the other hand, in the rotary type expander (60) of the present invention, the variation in flow velocity in the fluid towards the high-pressure chamber (73) becomes gradual, thereby making it possible to prevent fluid to be introduced from undergoing an abrupt variation in pressure. Therefore, in accordance with the present invention, it becomes possible to considerably reduce pulsation of fluid which is introduced into the rotary type expander (60). Attendant vibration and noise are reduced significantly, thereby making it possible to enhance the reliability of the rotary type expander (60).

In each of the third and fourteenth inventions, it is arranged such that the timing at which the low-pressure chamber (74) starts decreasing in volume from the maximum value in the former-stage-side rotary mechanism part (70) and the timing at which the high-pressure chamber (83) starts increasing in volume from the minimum value in the latter-stage-side rotary mechanism part (80) are synchronized to each other. As a result of this arrangement, high-pressure fluid supplied to the rotary type expander (60) expands smoothly, thereby making it possible to efficiently recover power from the high-pressure fluid.

In each of the fourth and fifth inventions, it is arranged such that the eccentric parts (41, 42) of the rotating shaft (40) are off-centered in different directions from each other. As a result of this arrangement, forces, which are applied to the rotating shaft (40) from fluids within the high-pressure chambers (73, 83) of the rotary mechanism parts (70, 80), differ from each other in direction of action and, as a result, offset each other to some extent. Therefore, in accordance with each of these inventions, it is possible to reduce radial loads acting on the rotating shaft (40) and thereby to reduce frictional loss between the rotating shaft (40) and its bearing. Consequently, it becomes possible to increase the efficiency of the rotary type expander (60) to a further extent, when compared to the case where the eccentric parts (41, 42) are off-centered in the same direction and, as a result, the rotating shaft (40) receives forces from fluids within the high-pressure chambers (73, 83) which act in the same direction.

Especially, in the fifth invention, it is arranged such that the eccentric directions of the eccentric parts (41, 42) in the rotating shaft (40) are at equiangular intervals. As a result of this arrangement, forces, which are applied to the rotating shaft (40) from fluids within the high-pressure chambers (73, 83) of the rotary mechanism parts (70, 80), have respective directions of action which are at equiangular intervals and, as a result, offset each other almost perfectly. Therefore, in accordance with this invention, it becomes possible to significantly reduce frictional loss between the rotating shaft (40) and its bearing, thereby making it possible to significantly increase the efficiency of the rotary type expander (60).

In each of the sixth and seventh inventions, it is arranged such that the angle, at which each cylinder (71, 81) is arranged, is deviated, thereby to reduce the length of the communicating passage (64) to a maximum extent. As a result of this arrangement, it becomes possible to reduce pressure loss in fluid from the low-pressure chamber (74) of the former-stage-side rotary mechanism part (70) to the high-pressure chamber (83) of the latter-stage-side rotary mechanism part (80), thereby making it possible to increase the amount of power recoverable by the rotary type expander (60).

In the eighth invention, it is arranged such that the communicating passage (64) is provided with the intermediate chamber (65) of relatively large volume. As a result of this arrangement, it becomes possible to reduce the variation in pressure in fluid flowing through the communicating passage (64) from the low-pressure chamber (74) of the former-stage-side rotary mechanism part (70) towards the high-pressure chamber (83) of the latter-stage-side rotary mechanism part (80).

In the eleventh invention, carbon dioxide in a supercritical state is introduced into the rotary type expander (60). In other words, the configuration of the present invention is applied to a rotary type expander suffering considerably harmful effects due to pulsation of fluid which is introduced thereinto and which is substantially incompressible. Therefore, in accordance with this invention, in regard to a conventional rotary type expander suffering considerably harmful effects due to pulsation of fluid at the time of introduction thereof, the generation of such fluid pulsation is suppressed without fail, thereby ensuring that the reliability of the rotary type expander is improved.

In each of the twelfth and thirteenth inventions, in the rotary type expander (60) which is housed along with the compressor (50) in the single casing (31), the rotary mechanism part (80) is arranged such that the greater its displacement volume is, the farther its position is away from the compressor (50). Stated another way, the lower the temperature of passing fluid is, the farther the rotary mechanism part (80) is away from the compressor (50), and it is arranged such that the rotary mechanism part (70) through which fluid of high temperature flows is possibly positioned nearer to the compressor (50). Therefore, in accordance with this invention, it becomes possible to further reduce the amount of heat transferring to fluid in the rotary type expander (60) from fluid discharged from the compressor (50), when compared to the case where the rotary mechanism part (80) of large displacement volume is positioned nearer to the compressor (50).

In the fifteenth invention, the heat insulating member (100) is provided to inhibit heat from transferring to fluid in the rotary type expander (60). Therefore, in according with this invention, it becomes possible to further reduce the amount of heat transferring from fluid discharged out of the compressor (50) to fluid in the rotary type expander (60).

BEST MODE FOR CARRYING OUT THE INVENTION

Embodiments of the present invention are described in detail below with reference to the accompanying drawings.

First Embodiment of the Invention

A first embodiment of the present invention is described. An air conditioner (10) of the present embodiment includes a rotary type expander according to the present invention.

Air Conditioner's Overall Configuration

Figure 1:
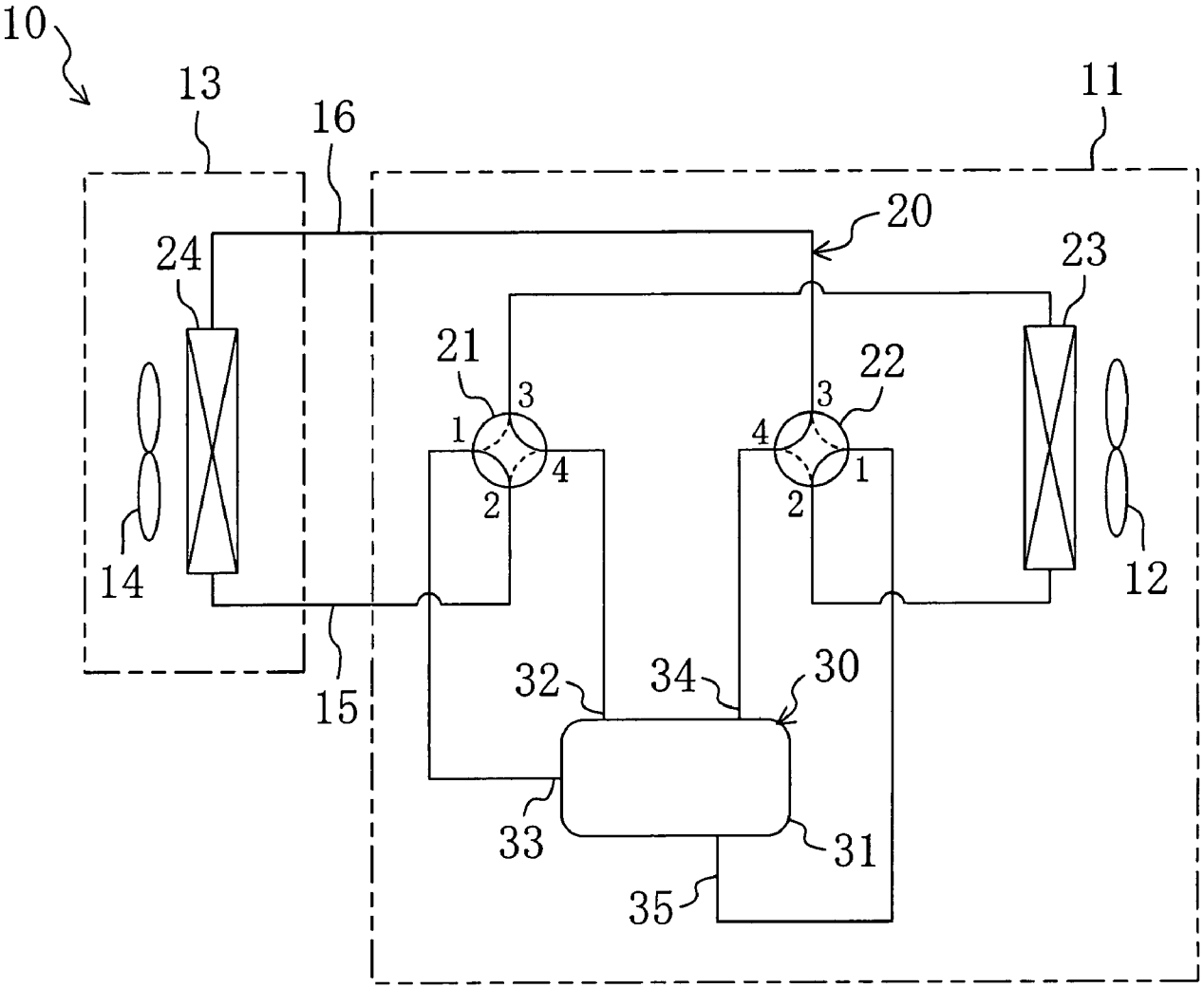
FIG. 1 is a piping system diagram of an air conditioner in a first embodiment of the present invention.

Referring to FIG. 1, the air conditioner (10) is of a so-called separate type. This air conditioner (10) is made up of an outdoor unit (11) and an indoor unit (13). The outdoor unit (11) houses an outdoor fan (12), an outdoor heat exchanger (23), a first four-way switching valve (21), a second four-way switching valve (22), and a compression and expansion unit (30). The indoor unit (13) houses an indoor fan (14) and an indoor heat exchanger (24). The outdoor unit (11) is installed outdoors. The indoor unit (13) is installed within a room. In addition, the outdoor unit (11) and the indoor unit (13) are in communication with each other by way of a pair of interunit pipe lines (15, 16). The compression and expansion unit (30) is hereinafter described in detail.

The air conditioner (10) is provided with a refrigerant circuit (20). The refrigerant circuit (20) is a closed circuit to which are connected the compression and expansion unit (30), the indoor heat exchanger (24) and so on. In addition, the refrigerant circuit (20) is charged with carbon dioxide ($CO_2$) as a refrigerant.

The outdoor heat exchanger (23) and the indoor heat exchanger (24) are formed by fin and tube heat exchangers of the cross fin type. In the outdoor heat exchanger (23), refrigerant circulating through the refrigerant circuit (20) exchanges heat with outside air. In the indoor heat exchanger (24), refrigerant circulating through the refrigerant circuit (20) exchanges heat with room air.

The first four-way switching valve (21) is a four-port valve. A first port of the first four-way switching valve (21) is in fluid communication with a discharge port (33) of the compression and expansion unit (30). A second port of the first four-way switching valve (21) is in fluid communication by way of the interunit pipe line (15) with one end of the indoor heat exchanger (24). A third port of the first four-way switching valve (21) is in fluid communication with one end of the outdoor heat exchanger (23). A fourth port of the first four-way switching valve (21) is in fluid communication with a suction port (32) of the compression and expansion unit (30). And, the first four-way switching valve (21) changes state between a first state (indicated by solid line in FIG. 1) which allows fluid communication between the first port and the second port and between the third port and the fourth port, and a second state (indicated by broken line in FIG. 1) which allows fluid communication between the first port and the third port and between the second port and the fourth port.

The second four-way switching valve (22) is a four-port valve. A first port of the second four-way switching valve (22) is in fluid communication with an outflow port (35) of the compression and expansion unit (30). A second port of the second four-way switching valve (22) is in fluid communication with the other end of the outdoor heat exchanger (23). A third port of the second four-way switching valve (22) is in fluid communication by way of the interunit pipe line (16) with the other end of the indoor heat exchanger (24). A fourth port of the second four-way switching valve (22) is in fluid communication with an inflow port (34) of the compression and expansion unit (30). And, the second four-way switching valve (22) changes state between a first state (indicated by solid line in FIG. 1) which allows fluid communication between the first port and the second port and between the third port and the fourth port, and a second state (indicated by broken line in FIG. 1) which allows fluid communication between the first port and the third port and between the second port and the fourth port.

Compression and Expansion Unit's Configuration

Figure 2:
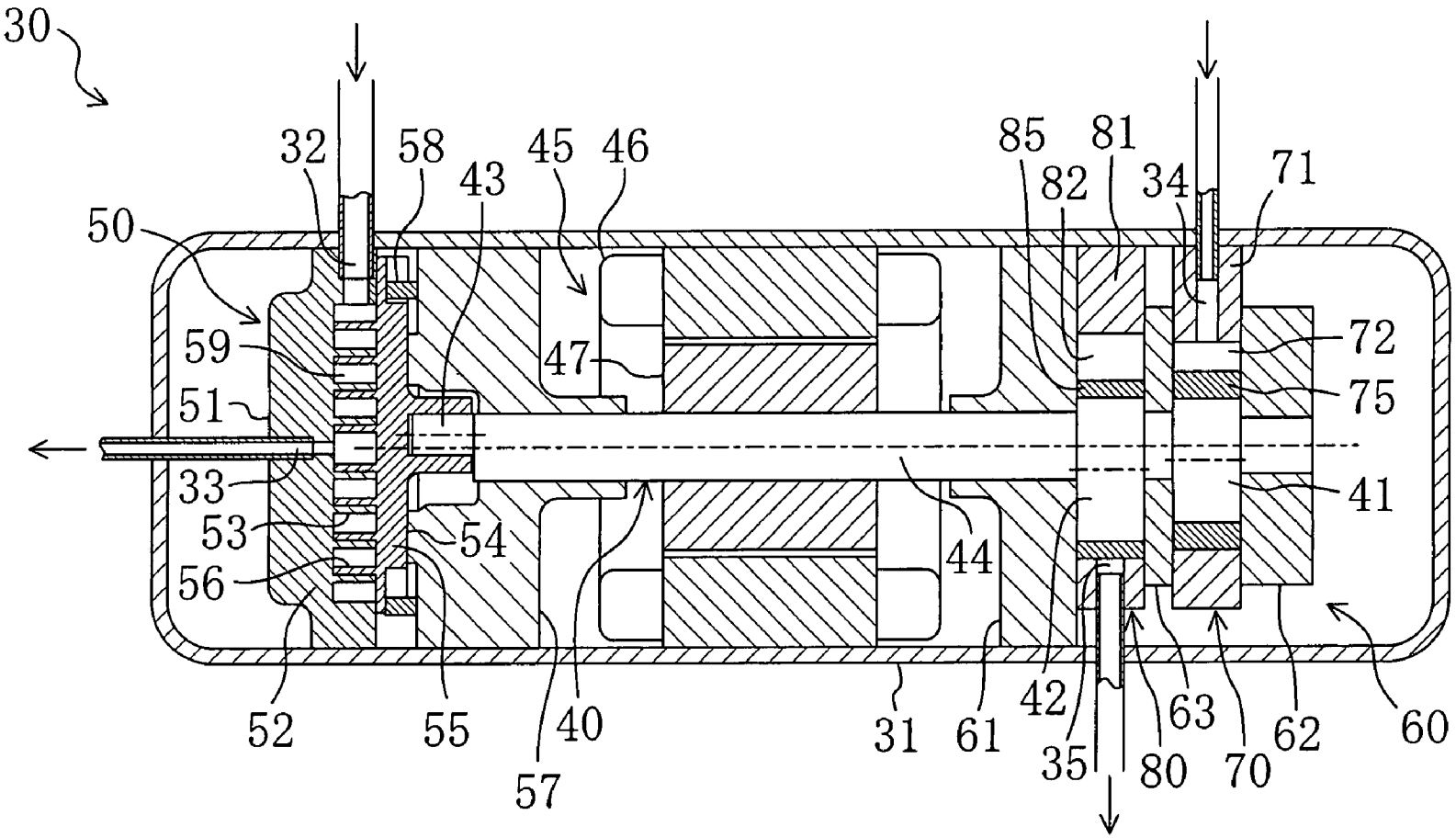
FIG. 2 is a schematic cross sectional diagram of a compression and expansion unit in the first embodiment.

As shown in FIG. 2, the compression and expansion unit (30) includes a casing (31) which is a horizontally long, cylinder-shaped, hermitically-closed container. Arranged, in sequence from the left to the right side relative to FIG. 2, within the casing (31) are a compression mechanism part (50), an electric motor (45), and an expansion mechanism part (60). The terms "right" and "left" used in the following description mean respectively the right and left side relative to the drawings referred to.

The electric motor (45) is disposed centrally in the casing (31) relative to the longitudinal direction thereof. The electric motor (45) is made up of a stator (46) and a rotor (47). The stator (46) is firmly secured to the casing (31). The rotor (47) is disposed inside the stator (46). In addition, a main shaft part (44) of a shaft (40) is passed through the rotor (47) coaxially with the rotor (47).

The shaft (40) constitutes a rotating shaft. The shaft (40) is provided, at its left end side, with a single smaller diameter eccentric part (43). In addition, the shaft (40) has at its right end side two greater diameter eccentric parts (41, 42).

The smaller diameter eccentric part (43) is formed such that it has a smaller diameter than that of the main shaft part (44). The smaller diameter eccentric part (43) is off-centered by a predetermined amount of eccentricity from the shaft center of the main shaft part (44). On the other hand, the greater diameter eccentric parts (41, 42) are formed such that they have a greater diameter than that of the main shaft part (44). Of the two greater diameter eccentric parts (41, 42) which are arranged side by side, one on the right side constitutes a first greater diameter eccentric part (41) and the other on the left side constitutes a second greater diameter eccentric part (42). Both the first and second greater diameter eccentric parts (41, 42) are off-centered in the same direction. The outside diameter of the second greater diameter eccentric part (42) is greater than the outside diameter of the first greater diameter eccentric part (41). In addition, the second greater diameter eccentric part (42) is greater in the amount of eccentricity relative to the shaft center of the main shaft part (44) than the first greater diameter eccentric part (41).

The compression mechanism part (50) constitutes a so-called scroll compressor. The compression mechanism part (50) includes a fixed scroll (51), an orbiting scroll (54), and a frame (57). In addition, the compression mechanism part (50) has a suction port (32) and a discharge port (33).

In the fixed scroll (51), a fixed-side wrap (53) shaped like a spiral wall is so formed in an end plate (52) as to project therefrom. The end plate (52) of the fixed scroll (51) is firmly secured to the casing (31). On the other hand, in the orbiting scroll (54), a movable-side wrap (56) shaped like a spiral wall is so formed in a plate-like end plate (55) as to project therefrom. The fixed scroll (51) and the orbiting scroll (54) are disposed in a postural position such that they face with each other. And, the fixed-side wrap (53) and the movable-side wrap (56) engage each other to define a compression chamber (59).

One end of the suction port (32) is in fluid communication with the outer peripheral side of the fixed-side wrap (53) and with the outer peripheral side of the movable-side wrap (56). On the other hand, the discharge port (33) is fluidly connected to the center of the end plate (52) of the fixed scroll (51), and one end of the discharge port (33) opens to the compression chamber (59).

The end plate (55) of the orbiting scroll (54) is provided, at the center of its right side surface, with a projecting portion. The smaller diameter eccentric part (43) of the shaft (40) is inserted into the projection portion. In addition, the orbiting scroll (54) is supported, through an Oldham ring (58), on the frame (57). The Oldham ring (58) is provided to restrict the rotation of the orbiting scroll (54). And, the orbiting scroll (54) orbits at a predetermined turning radius without rotating itself.

The expansion mechanism part (60) is a so-called swinging piston type fluid machine which constitutes a rotary type expander of the present invention. The expansion mechanism part (60) is provided with two pair combinations of cylinders (81, 82) and pistons (75, 85). The expansion mechanism part (60) further includes a front head (61), an intermediate plate (63), and a rear head (62).

In the expansion mechanism part (60), the front head (61), the second cylinder (81), the intermediate plate (63), the first cylinder (71), and the rear head (62) are stacked in layers in that order from the left to the right side relative to FIG. 2. In this state, the left end surface of the second cylinder (81) is blocked by the front head (61) and the right end surface thereof is blocked by the intermediate plate (63). On the other hand, the left end surface of the first cylinder (71) is blocked by the intermediate plate (63) and the right end surface thereof is blocked by the rear head (62). In addition, the inside diameter of the second cylinder (81) is greater than the inside diameter of the first cylinder (71).

The shaft (40) is passed through the front head (61), the second cylinder (81), the intermediate plate (63), the first cylinder (71), and the rear head (62) which are stacked in layers. Additionally, the first greater diameter eccentric part (41) of the shaft (40) lies within the first cylinder (71) while on the other hand the second greater diameter eccentric part (42) of the shaft (40) lies within the second cylinder (81).

Figure 3:
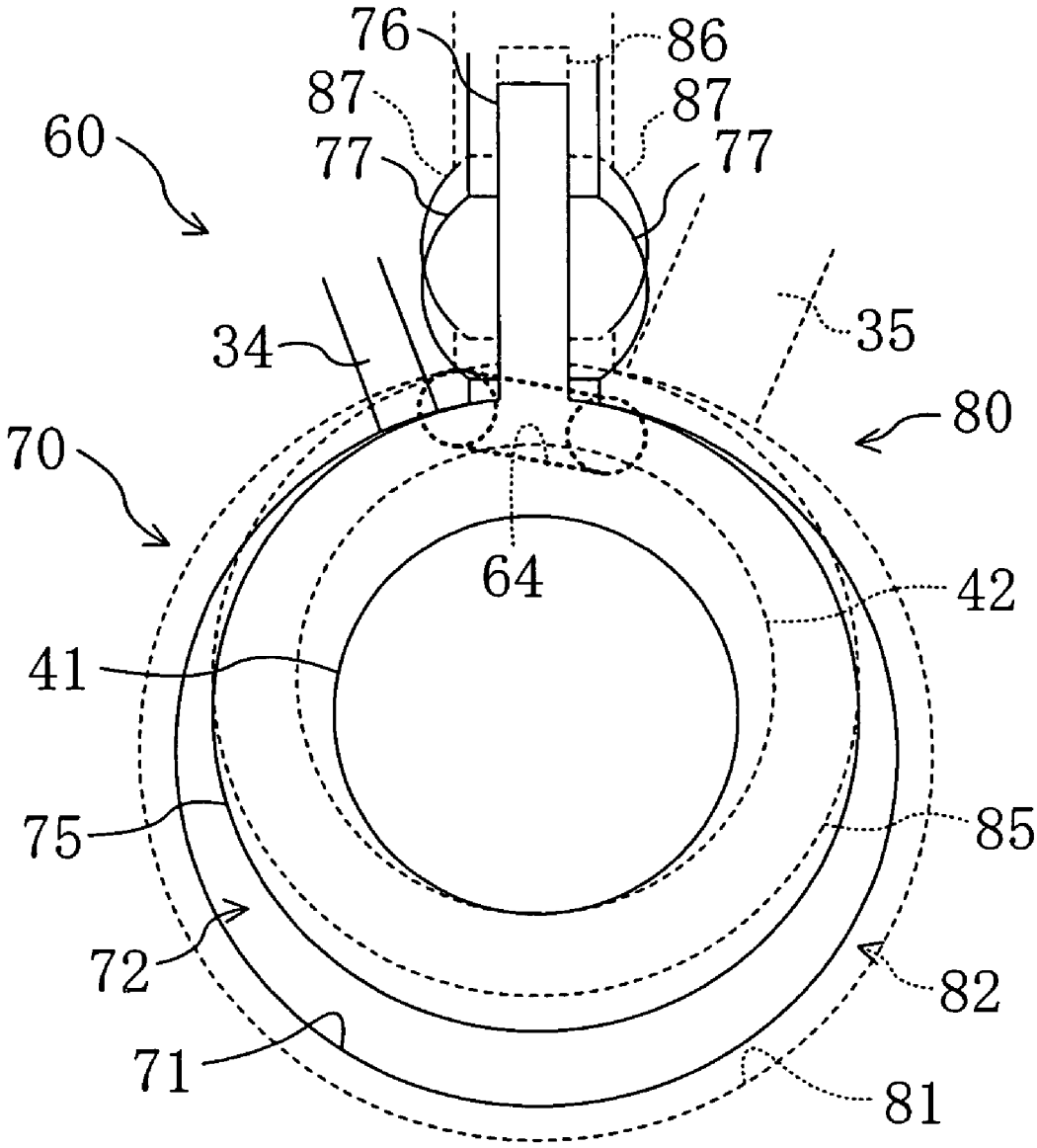
FIG. 3 is a diagram which illustrates, in enlarged manner, a major section of an expansion mechanism part in the first embodiment.
Figure 4:
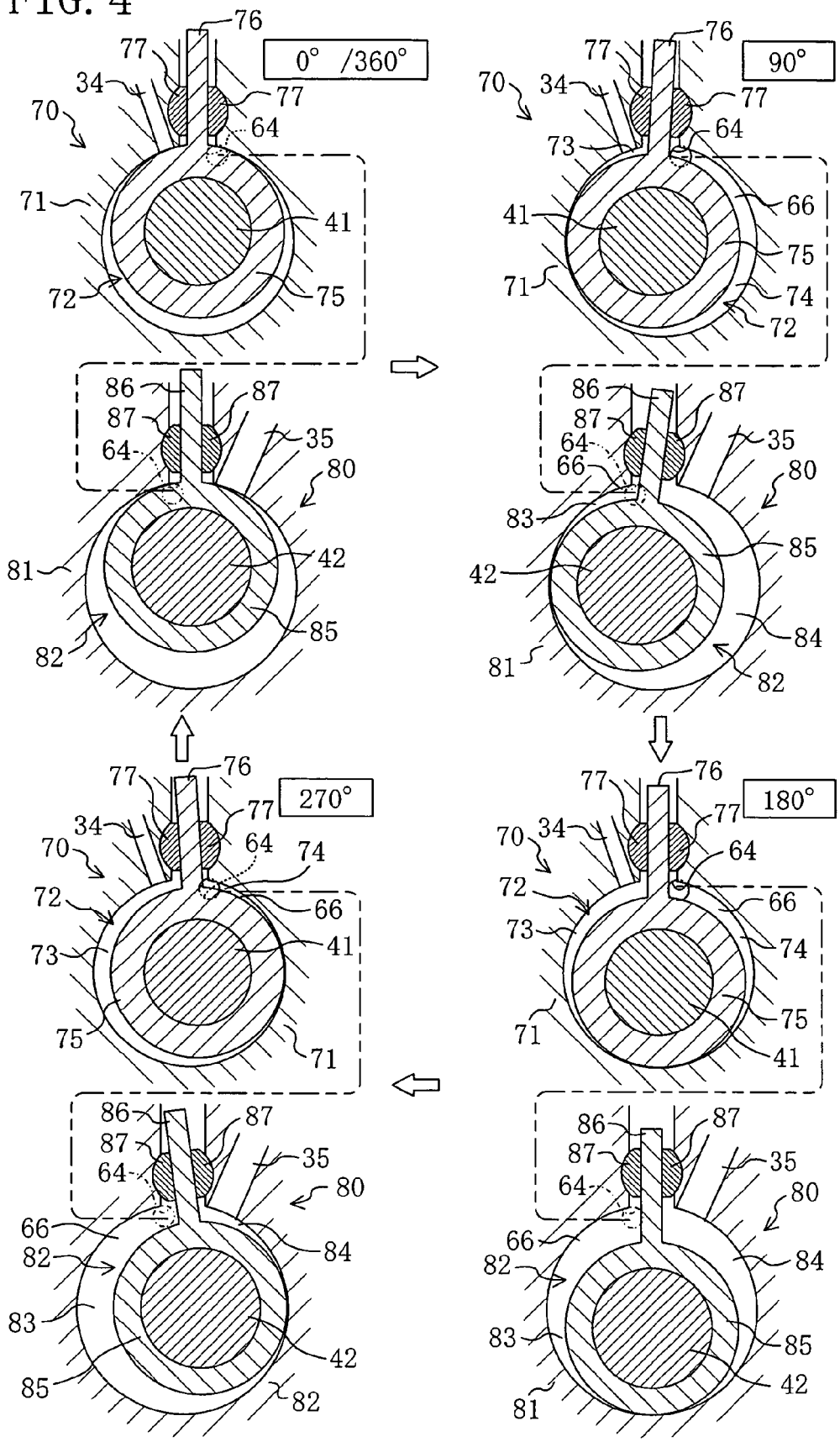
FIG. 4 is a major-section-enlarged diagram which illustrates the states of each rotary mechanism part for every shaft rotational angle of 90° in the expansion mechanism part of the first embodiment.

As shown in FIGS. 3 and 4, the first piston (75) and the second piston (85) are mounted within the first cylinder (75) and within the second cylinder (85), respectively. The first and second pistons (75, 85) are each shaped like a circular ring or like a cylinder. The first piston (75) and the second piston (85) are the same in outside diameter. The inside diameter of the first piston (75) approximately equals the outside diameter of the first greater diameter eccentric part (41). The inside diameter of the second piston (85) approximately equals the outside diameter of the second greater diameter eccentric part (42). And, the first greater diameter eccentric part (41) is passed through the first piston (75) while on the other hand the second greater diameter eccentric part (42) is passed through the second piston (85).

The first piston (75) is, at its outer peripheral surface, in sliding contact with the inner peripheral surface of the first cylinder (71). One end surface of the first piston (75) is in sliding contact with the rear head (62). The other end surface of the first piston (75) is in sliding contact with the intermediate plate (63). Within the first cylinder (71), a first fluid chamber (72) is formed between the inner peripheral surface of the first cylinder (71) and the outer peripheral surface of the first piston (75). On the other hand, the second piston (85) is, at its outer peripheral surface, in sliding contact with the inner peripheral surface of the second cylinder (81). One end surface of the second piston (85) is in sliding contact with the front head (61). The other end surface of the second piston (85) is in sliding contact with the intermediate plate (63). Within the second cylinder (81), a second fluid chamber (82) is formed between the inner peripheral surface of the second cylinder (81) and the outer peripheral surface of the second piston (85).

The first piston (75) is provided with a single blade (76) which is formed integrally with the first piston (75). The second piston (85) is provided with a single blade (86) which is formed integrally with the second piston (85). The blade (75, 85) is shaped like a plate extending in the radial direction of the piston (75, 85), and projects outwardly from the outer peripheral surface of the piston (75, 85).

Each cylinder (71, 81) is provided with a respective pair of bushes (77, 87). Each bush (77, 87) is a small piece which is formed such that it has an inside surface which is a flat surface and an outside surface which is a circular arc surface. One pair of bushes (77, 87) are disposed with the blade (76, 86) sandwiched therebetween. The inside surface of each bush (77, 87) is in sliding contact with the blade (76, 86) while on the other hand the outside surface thereof is in sliding contact with the cylinder (81, 82). And, the blade (76, 86) integral with the piston (75, 85) is supported on the cylinder (71, 81) through the bush (77, 87). The blade (76, 86) is allowed to freely rotate and to go up and down relative to the cylinder (71, 81).

The first fluid chamber (72) within the first cylinder (71) is divided by the first blade (76) integral with the first piston (75), wherein one space defined on the left side of the first blade (76) in FIG. 4 becomes a first high-pressure chamber (73) of high-pressure side while on the other hand the other space defined on the right side of the first blade (76) in FIG. 4 becomes a first low-pressure chamber (74) of low-pressure side. The second fluid chamber (82) within the second cylinder (81) is divided by the second blade (86) integral with the second piston (85), wherein one space defined on the left side of the second blade (86) in FIG. 4 becomes a second high-pressure chamber (83) of high-pressure side while on the other hand the other space defined on the right side of the second blade (86) in FIG. 4 becomes a second low-pressure chamber (84) of low-pressure side.

The first cylinder (71) and the second cylinder (81) are arranged such that the positions of the buses (77, 87) relative to their circumferential direction correspond with each other. In other words, the disposition angle of the second cylinder (81) with respect to the first cylinder (71) is 0°. As described above, the first greater diameter eccentric part (41) and the second greater diameter eccentric part (42) are off-centered in the same direction relative to the shaft center of the main shaft part (44). Accordingly, at the same time that the first blade (76) reaches its most withdrawn position relative to the direction of the outer periphery of the first cylinder (71), the second blade (86) reaches its most withdrawn position relative to the direction of the outer periphery of the second cylinder (81).

The first cylinder (71) is provided with an inflow port (34). The inflow port (34) opens at a location of the inner peripheral surface of the first cylinder (71) somewhat nearer to the left side of the bush (77) in FIGS. 3 and 4. The inflow port (34) is allowed to be in fluid communication with the first high-pressure chamber (73) (i.e., the high-pressure side of the first fluid chamber (72)). On the other hand, the second cylinder (81) is provided with an outflow port (35). The outflow port (35) opens at a location of the inner peripheral surface of the second cylinder (81) somewhat nearer to the right side of the bush (87) in FIGS. 3 and 4. The outflow port (35) is allowed to be in fluid communication with the second low-pressure chamber (84) (i.e., the low-pressure side of the second fluid chamber (82)).

The intermediate plate (63) is provided with a communicating passage (64). The communicating passage (64) is formed such that it extends through the intermediate plate (63). In one surface of the intermediate plate (63) on the side of the first cylinder (71), one end of the communicating passage (64) opens at a location on the right side of the first blade (76). In the other surface of the intermediate plate (63) on the side of the second cylinder (81), the other end of the communicating passage (64) opens at a location on the left side of the second blade (86). And, as shown in FIG. 3, the communicating passage (64) extends obliquely with respect to the thickness direction of the intermediate plate (63) and becomes able to fluidly communicate with the first low-pressure chamber (74) (i.e., the low-pressure side of the first fluid chamber (72)) and with the second high-pressure chamber (83) (i.e., the high-pressure side of the second fluid chamber (82)).

In the expansion mechanism part (60) of the present embodiment constructed in the way as described above, the first cylinder (71), the buses (77) mounted in the first cylinder (71), the first piston (75), and the first blade (76) together constitute a first rotary mechanism part (70). In addition, the second cylinder (81), the buses (87) mounted in the second cylinder (81), the second piston (85), and the second blade (86) together constitute a second rotary mechanism part (80).

As described above, in the expansion mechanism part (60), the timing at which the first blade (76) reaches its most withdrawn position relative to the direction of the outer periphery of the first cylinder (71), and the timing at which the second blade (86) reaches its most withdrawn position relative to the direction of the outer periphery of the second cylinder (81) are synchronized with each other. In other words, the process in which the volume of the first low-pressure chamber (74) decreases in the first rotary mechanism part (70), and the process in which the volume of the second high-pressure chamber (83) increases in the second rotary mechanism part (80) are in synchronization (see FIG. 4). In addition, as described above, the first low-pressure chamber (74) of the first rotary mechanism part (70) and the second high-pressure chamber (83) of the second rotary mechanism part (80) are in fluid communication with each other by way of the communicating passage (64). And, the first low-pressure chamber (74), the communicating passage (64), and the second high-pressure chamber (83) together form a single closed space. The closed space constitutes the expansion chamber (66). This is described with reference to FIG. 5.

Figure 5:
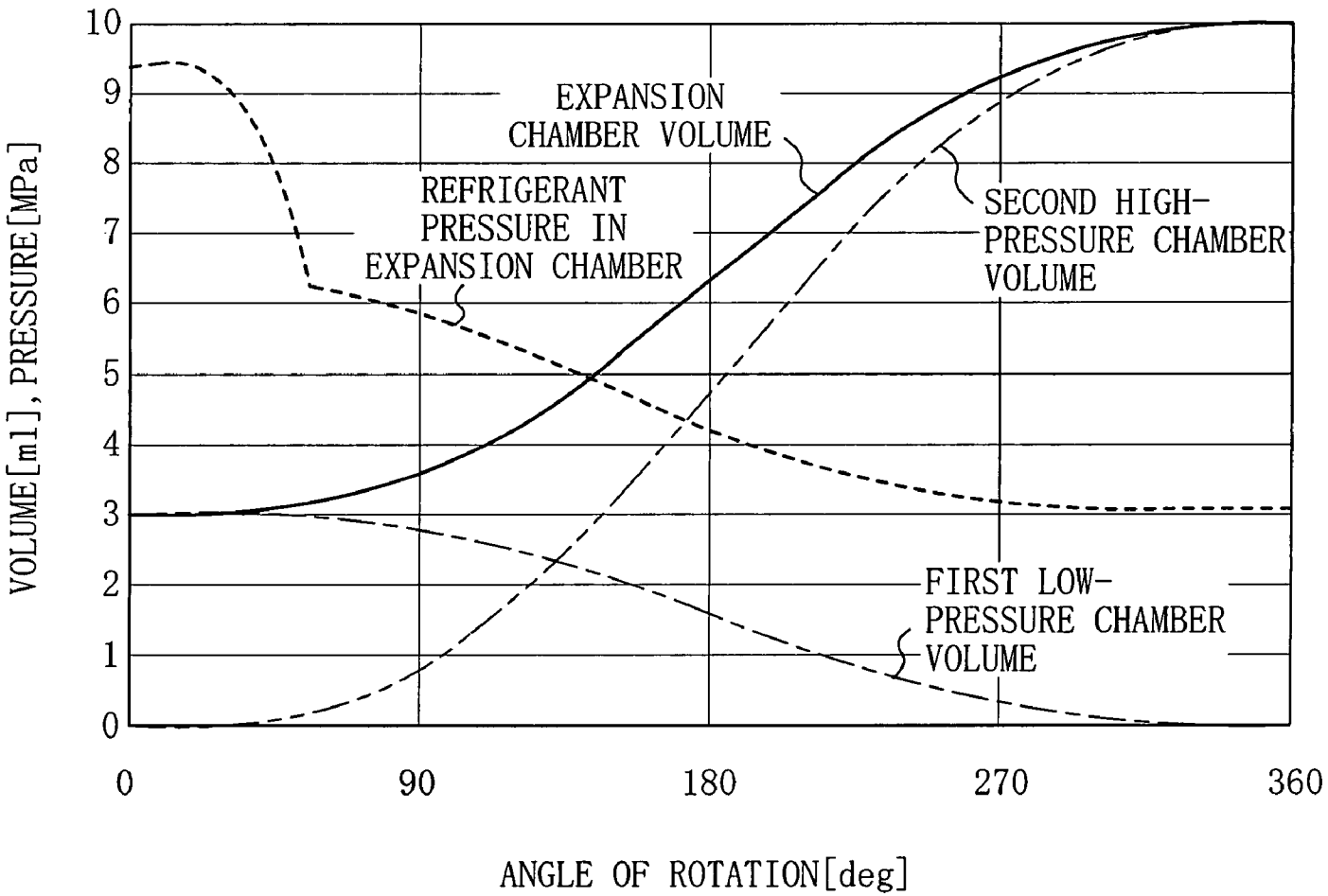
FIG. 5 is a correlational diagram which illustrates the relationship of the shaft rotational angle with respect to the volumes of chambers including an expansion chamber/the expansion chamber internal pressure in the expansion mechanism part of the first embodiment.

In FIG. 5, the rotational angle of the shaft (40) when the first blade (76) reaches its most withdrawn position relative to the direction of the outer periphery of the first cylinder (71) is 0°. In addition, the description is made here, assuming that the maximum volume of the first fluid chamber (72) is 3 ml (milliliter) while on the other hand, the maximum volume of the second fluid chamber (82) is 10 ml.

With reference to FIG. 5, when the rotational angle of the shaft (40) is 0°, the volume of the first low-pressure chamber (74) assume its maximum value of 3 ml and the volume of the second high-pressure chamber (83) assumes its minimum value of 0 ml. The volume of the first low-pressure chamber (74), as indicated by alternate long and short dash line in FIG.

5, gradually decreases as the shaft (40) rotates and, when the rotational angle of the shaft (40) reaches a point of 360°, assumes its minimum value of 0 ml. On the other hand, the volume of the second low-pressure chamber (84), as indicated by chain double-dashed line in FIG. 5, gradually increases as the shaft (40) rotates and, when the rotational angle of the shaft (40) reaches a point of 360°, assumes its maximum value of 10 ml. And, the volume of the expansion chamber (66) at a certain rotational angle of the shaft (40) is the sum of the volume of the first low-pressure chamber (74) and the volume of the second low-pressure chamber (84) at that certain rotational angle, when leaving the volume of the communicating passage (64) out of count. In other words, the volume of the expansion chamber (66), as indicated by solid line in FIG. 5, assumes a minimum value of 3 ml when the rotational angle of the shaft (40) is 0°. As the shaft (40) rotates, the volume of the expansion chamber (66) gradually increases and assumes a maximum value of 10 ml when the rotational angle of the shaft (40) reaches a point of 360°.

Running Operation

The operation of the air conditioner (10) is described. Hereinafter, the operation of the air conditioner (10) during cooling operating mode and the operation of the air conditioner (10) during heating operating mode are first described, and the operation of the expansion mechanism part (60) is then described.

Cooling Operating Mode

In the cooling operating mode, the first four-way switching valve (21) and the second four-way switching valve (22) each change state to the state indicated by broken line in FIG. 1. In this state, upon energization of the electric motor (45) of the compression and expansion unit (30), refrigerant circulates through the refrigerant circuit (20) whereby a vapor compression refrigeration cycle is performed.

Refrigerant compressed in the compression mechanism part (50) passes through the discharge port (33) and is then discharged out of the compression and expansion unit (30). In this state, the refrigerant is at a pressure above its critical pressure. This discharged refrigerant is delivered by way of the first four-way switching valve (21) to the outdoor heat exchanger (23). In the outdoor heat exchanger (23), the inflow refrigerant dissipates heat to outside air.

The refrigerant after heat dissipation in the outdoor heat exchanger (23) passes through the second four-way switching valve (22) and then through the inflow port (34) and flows into the expansion mechanism part (60) of the compression and expansion unit (30). In the expansion mechanism part (60), the high-pressure refrigerant expands and its internal energy is converted into power used to rotate the shaft (40). The after-expansion low-pressure refrigerant flows out of the compression and expansion unit (30) through the outflow port (35), passes through the second four-way switching valve (22), and is delivered to the indoor heat exchanger (24).

In the indoor heat exchanger (24), the inflow refrigerant absorbs heat from room air and evaporates and, as a result, the room air is cooled. Low-pressure gas refrigerant exiting the indoor heat exchanger (24) passes through the first four-way switching valve (21) and then through the suction port (32) and is drawn into the compression mechanism part (50) of the compression and expansion unit (30). The compression mechanism part (50) compresses the refrigerant drawn thereinto and discharges it therefrom.

Heating Operating Mode

In the heating operating mode, the first four-way switching valve (21) and the second four-way switching valve (22) each change state to the state indicated by solid line in FIG. 1. In this state, upon energization of the electric motor (45) of the compression and expansion unit (30), refrigerant circulates through the refrigerant circuit (20) whereby a vapor compression refrigeration cycle is performed.

Refrigerant compressed in the compression mechanism part (50) passes through the discharge port (33) and is then discharged out of the compression and expansion unit (30). In this state, the refrigerant is at a pressure above its critical pressure. This discharged refrigerant passes through the first four-way switching valve (21) and is then delivered to the indoor heat exchanger (24). In the indoor heat exchanger (24), the inflow refrigerant dissipates heat to room air and, as a result, the room air is heated.

The refrigerant after heat dissipation in the indoor heat exchanger (24) passes through the second four-way switching valve (22) and then through the inflow port (34) and flows into the expansion mechanism part (60) of the compression and expansion unit (30). In the expansion mechanism part (60), the high-pressure refrigerant expands and its internal energy is converted into power used to rotate the shaft (40). The after-expansion low-pressure refrigerant flows out of the compression and expansion unit (30) by way of the outflow port (35), passes through the second four-way switching valve (22), and is delivered to the outdoor heat exchanger (23).

In the outdoor heat exchanger (23), the inflow refrigerant absorbs heat from outside air and evaporates. The low-pressure gas refrigerant exiting the outdoor heat exchanger (23) passes through the first four-way switching valve (21) and then through the suction port (32) and is drawn into the compression mechanism part (50) of the compression and expansion unit (30). The compression mechanism part (50) compresses the refrigerant drawn thereinto and discharges it therefrom.

Operation of the Expansion Mechanism Part

The operation of the expansion mechanism part (60) is described below.

Figure 6:
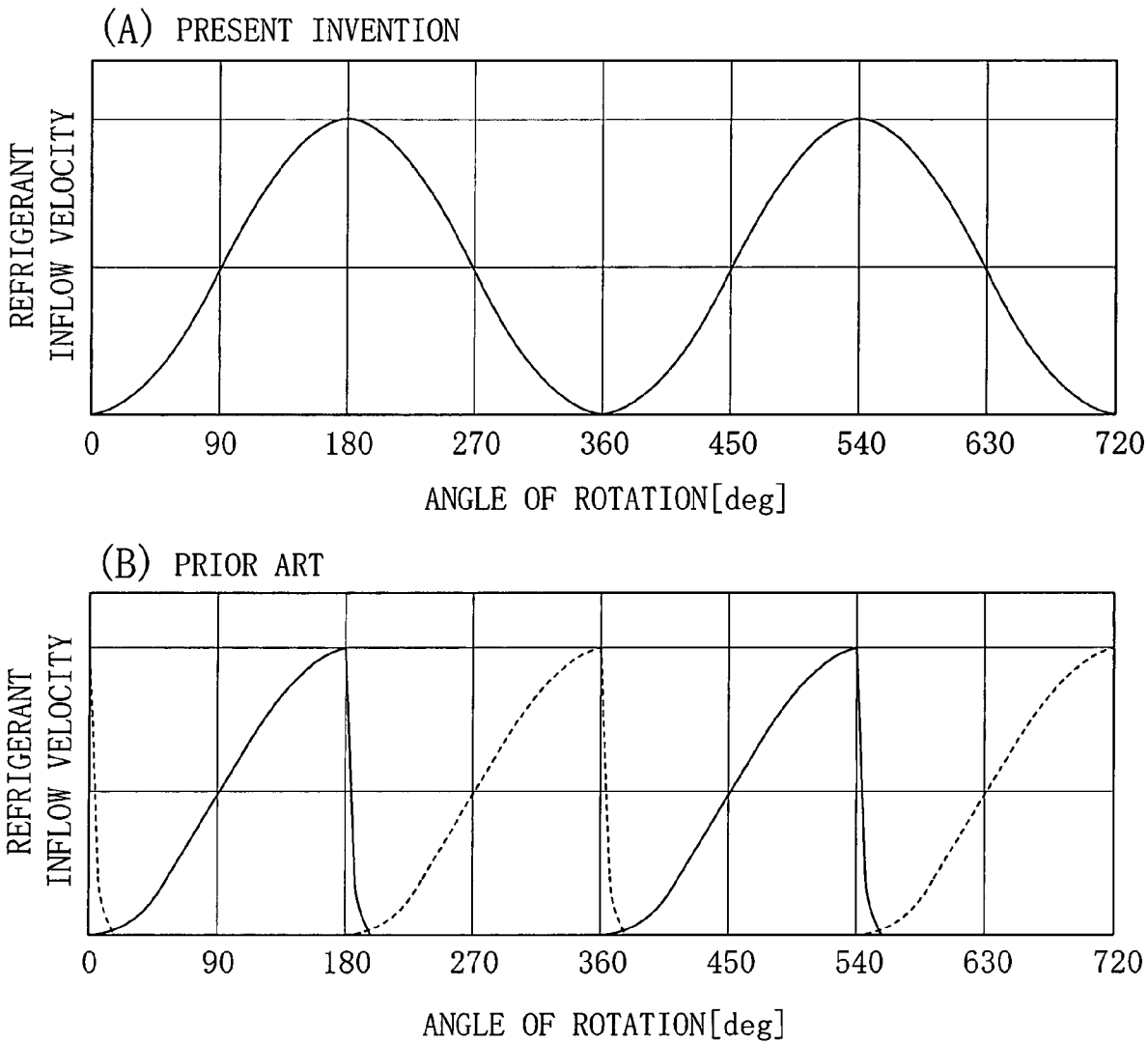
FIG. 6 is comprised of FIG. 6(A) and FIG. 6(B), wherein the former is a correlational diagram which illustrates the relationship between the shaft rotational angle and the fluid inflow velocity for the expansion mechanism part of the first embodiment while the latter is a correlational diagram which illustrates the relationship between the shaft rotational angle and the fluid inflow velocity for a conventional rotary type expander.

In the first place, by making reference to FIGS. 4 and 6, the process in which high-pressure refrigerant in a supercritical state flows into the first high-pressure chamber (73) of the first rotary mechanism part (70) is described. When the shaft (40) makes a slight rotation from the rotational angle 0° state, the position of contact between the first piston (75) and the first cylinder (71) passes through the opening part of the inflow port (34), thereby allowing high-pressure refrigerant to start flowing into the first high-pressure chamber (73) from the inflow port (34). Thereafter, as the rotational angle of the shaft (40) gradually increases to an angle of 90°, then to an angle of 180°, and then to an angle of 270°, high-pressure refrigerant keeps flowing into the first high-pressure chamber (73). The inflowing of high-pressure refrigerant into the first high-pressure chamber (73) continues until the rotational angle of the shaft (40) reaches an angle of 360°.

At that time, the flow velocity of the high-pressure refrigerant flowing into the first high-pressure chamber (73) gradually increases in the rotational angle range of the shaft (40) from 0° to 180° while on the other hand it decreases in the rotational angle range of the shaft (40) from 180° to 360°. And, at the point of time when the rotational angle of the shaft (40) reaches an angle of 360° and the flow velocity variation ratio of the high-pressure refrigerant becomes zero, the inflowing of the high-pressure refrigerant into the first high-pressure chamber (73) comes to an end.

Next, by making reference to FIGS. 4 and 5, the process in which refrigerant expands in the expansion mechanism part (60) is described. When the shaft (40) makes a slight rotation from the rotational angle 0° state, both the first low-pressure chamber (74) and the second high-pressure chamber (83) become fluidly communicative with the communicating passage (64) and, as a result, refrigerant starts flowing into the second high-pressure chamber (83) from the first low-pressure chamber (74). Thereafter, as the rotational angle of the shaft (40) gradually increases to an angle of 90°, then to an angle of 180°, and then to an angle of 270°, the volume of the first low-pressure chamber (74) gradually decreases while simultaneously the volume of the second high-pressure chamber (83) gradually increases. Consequently, the volume of the expansion chamber (66) gradually increases. The expansion chamber (66) continues to increase in its volume just before the rotational angle of the shaft (40) reaches an angle of 360°. And, in the process during which the volume of the expansion chamber (66) increases, refrigerant in the expansion chamber (66) expands. By virtue of such refrigerant expansion, the shaft (40) is rotationally driven. In this way, the refrigerant within the first low-pressure chamber (74) flows by way of the communication passage (64) into the second high-pressure chamber (83) while expanding.

In the process in which refrigerant expands, the refrigerant pressure within the expansion chamber (66) gradually falls as the rotational angle of the shaft (40) increases, as indicated by broken line in FIG. 5. More specifically, the supercritical-state refrigerant filling the first low-pressure chamber (74) undergoes an abrupt pressure drop during a period of time in which the rotational angle of the shaft (40) reaches an angle of about 55°, and enters a saturated liquid state. Thereafter, the refrigerant within the expansion chamber (66) gradually decreases in pressure while partially evaporating.

Subsequently, by making reference to FIG. 4, the process in which refrigerant flows out of the second low-pressure chamber (84) of the second rotary mechanism (80) is described. The second low-pressure chamber (84) starts fluidly communicating with the outflow port (35) from the time of point when the rotational angle of the shaft (40) is 0°. Stated another way, the refrigerant starts flowing out to the outflow port (35) from the second low-pressure chamber (84). Thereafter, the rotational angle of the shaft (40) gradually increases to an angle of 90°, then to an angle of 180°, and then to an angle of 270°. During a period of time in which the rotational angle of the shaft (40) reaches an angle of 360°, the after-expansion low-pressure refrigerant continuously flows out of the second low-pressure chamber (84).

Effects of the First Embodiment

Here, in a conventional rotary type expander, high-pressure refrigerant is introduced partway during the process in which the volume of a fluid chamber increases within a single cylinder. After the flow of the high-pressure refrigerant is interrupted, refrigerant is expanded within the fluid chamber, in association with which the flow velocity of high-pressure refrigerant flowing into the high-pressure chamber gradually increases as the shaft rotates, as shown in FIG. 6(B); however, it abruptly falls to zero at the point of time when the rotational angle of the shaft assumes a predetermined value. This consequently causes an abrupt variation in pressure on the inflow side of the rotary type expander, and attendant noise and vibration become excessive. Note that FIG. 6(B) depicts a case where two cylinders are provided in which the introducing of refrigerant into a first cylinder (indicated by solid line) and the introducing of refrigerant into a second cylinder (indicated by broken line) are carried out alternately.

On the contrary, in the expansion mechanism part (60) of the present embodiment, the flow velocity of refrigerant flowing into the first high-pressure chamber (73) by way of the inflow port (34) changes gradually as the shaft (40) rotates (see FIG. 6(A)). And, also in the pipe line in fluid connection with the inflow port (34) of the expansion mechanism part (60), the flow velocity of refrigerant within the pipe line changes gradually. This makes it possible to prevent an abrupt variation in refrigerant pressure from occurring in association with the operation of the expansion mechanism part (60). Therefore, in accordance with the present embodiment, pulsation of refrigerant which is introduced into the expansion mechanism part (60) is reduced considerably, and attendant vibration and noise are significantly reduced. As a result, the reliability of the expansion mechanism part (60) is enhanced.

Variational Example of the First Embodiment

In the present embodiment, the expansion mechanism part (60) may be configured as follows.

Figure 7:
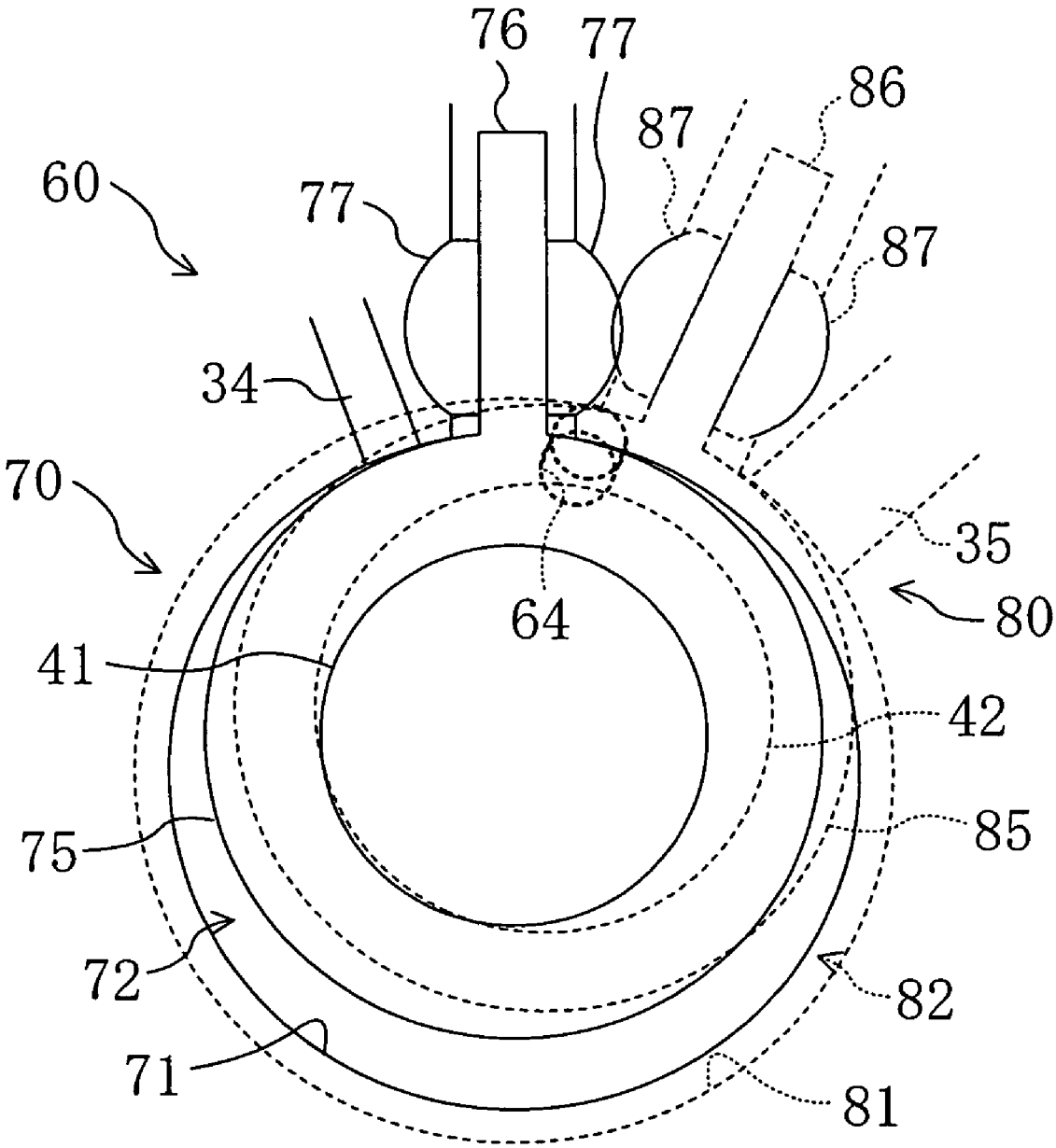
FIG. 7 is a major-section-enlarged diagram of an expansion mechanism part in a first variational example of the first embodiment.

More specifically, as shown in FIG. 7, the second cylinder (81) is positionally deviated by a predetermined angle with respect to the first cylinder (71) so that the opening portions of the communicating passage (64) at the both side surfaces of the intermediate plate (63) overlap each other. In the shaft (40) of the present variational example, the direction in which the first greater diameter eccentric part (41) is off-centered and the direction in which the second greater diameter eccentric part (42) is off-centered differ from each other. More specifically, it is arranged such that the angle formed between the eccentric direction of the first greater diameter eccentric part (41) and the eccentric direction of the second greater diameter eccentric part (42) equals the angle at which the second cylinder (81) is arranged to the first cylinder (71). Accordingly, also in the present variational example, the timing at which the first blade (76) reaches its most withdrawn position relative to the direction of the outer periphery of the first cylinder (71) is in synchronization with the timing at which the second blade (86) reaches its most withdrawn position relative to the direction of the outer periphery of the second cylinder (81).

In the present variational example, the opening position of the communicating passage (64) at one surface of the intermediate plate (63) on the side of the first cylinder (71), and the opening position of the communicating passage (64) at the other surface on the side of the second cylinder (81) substantially agree with each other in the circumferential direction of the cylinders (71, 81). Consequently, the communicating passage (64) of the present variational example is formed so as to extend substantially in the thickness direction of the intermediate plate (63) and the length of the communicating passage (64) becomes minimum. Accordingly, the present variational example reduces pressure loss of refrigerant during its flow from the first low-pressure chamber (74) of the first rotary mechanism part (70) to the second high-pressure chamber (83) of the second rotary mechanism (80), thereby making it possible to increase the amount of power recoverable by the expansion mechanism part (60).

Second Variational Example of the First Embodiment

Figure 8:
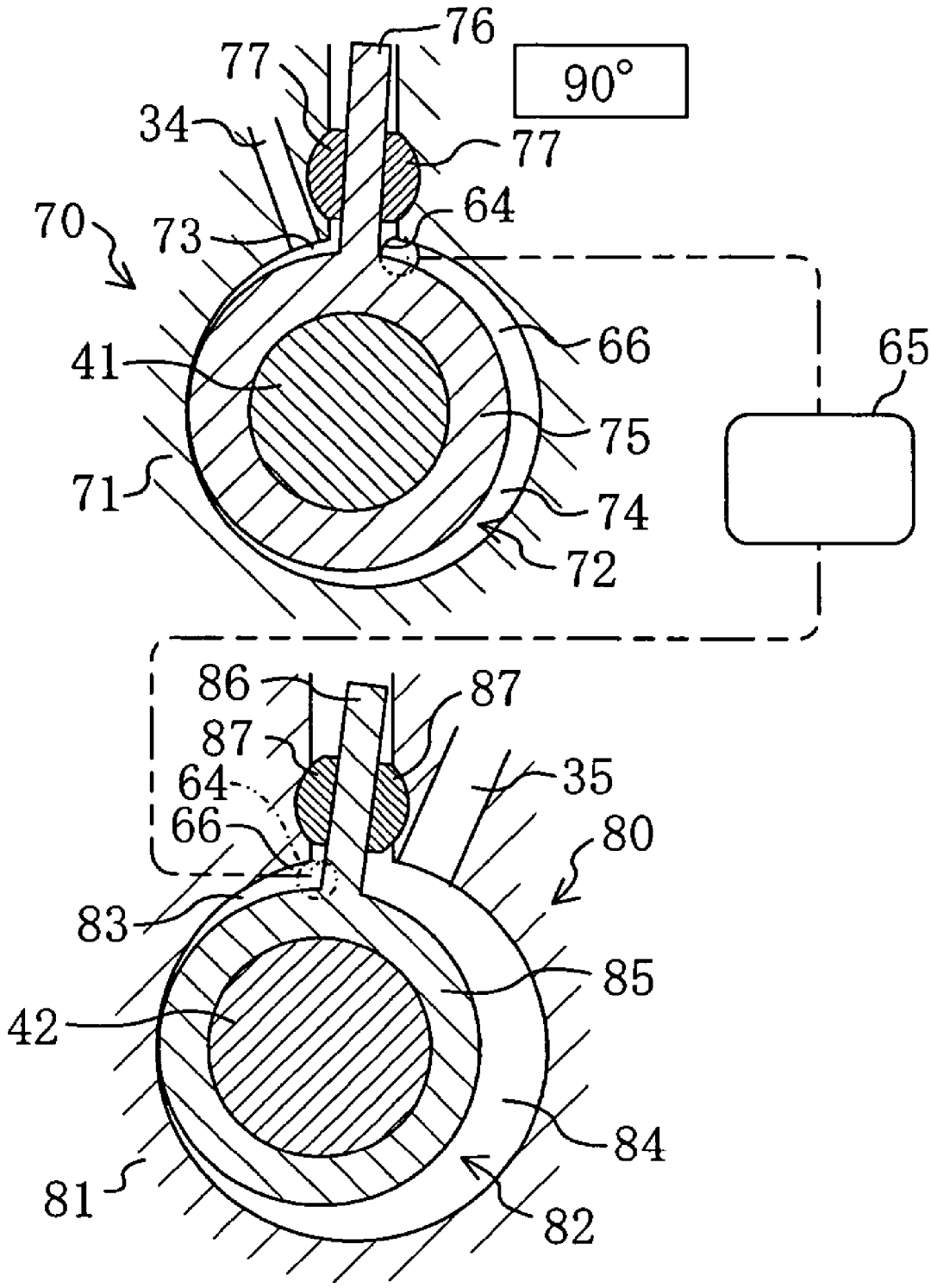
FIG. 8 is a major-section-enlarged diagram of an expansion mechanism part in a second variational example of the first embodiment.

In the expansion mechanism part (60) of the present embodiment, it may be arranged such that an intermediate chamber (65) is provided along the communicating passage (64), as shown in FIG. 8. The intermediate chamber (65) is formed, such that it has a relatively great volume. For example, the volume of the intermediate chamber (65) is greater than the volume of the communicating passage (64) itself. By virtue of the provision of the intermediate chamber (65), the variation in refrigerant pressure in the communicating passage (64) is reduced, for example, at the time when refrigerant starts flowing into the communicating passage (64) from the first low-pressure chamber (74). This suppresses pulsation of refrigerant flowing towards the second high-pressure chamber (83) from the first low-pressure chamber (74) by way of the communicating passage (64).

Second Embodiment of the Present Invention

A second embodiment of the present invention is described. The present embodiment results from modification of the configuration of the expansion mechanism part (60) of the first embodiment. Here, the difference between the first embodiment and the present embodiment as regards the configuration of the expansion mechanism part (60) is described.

Figure 9:
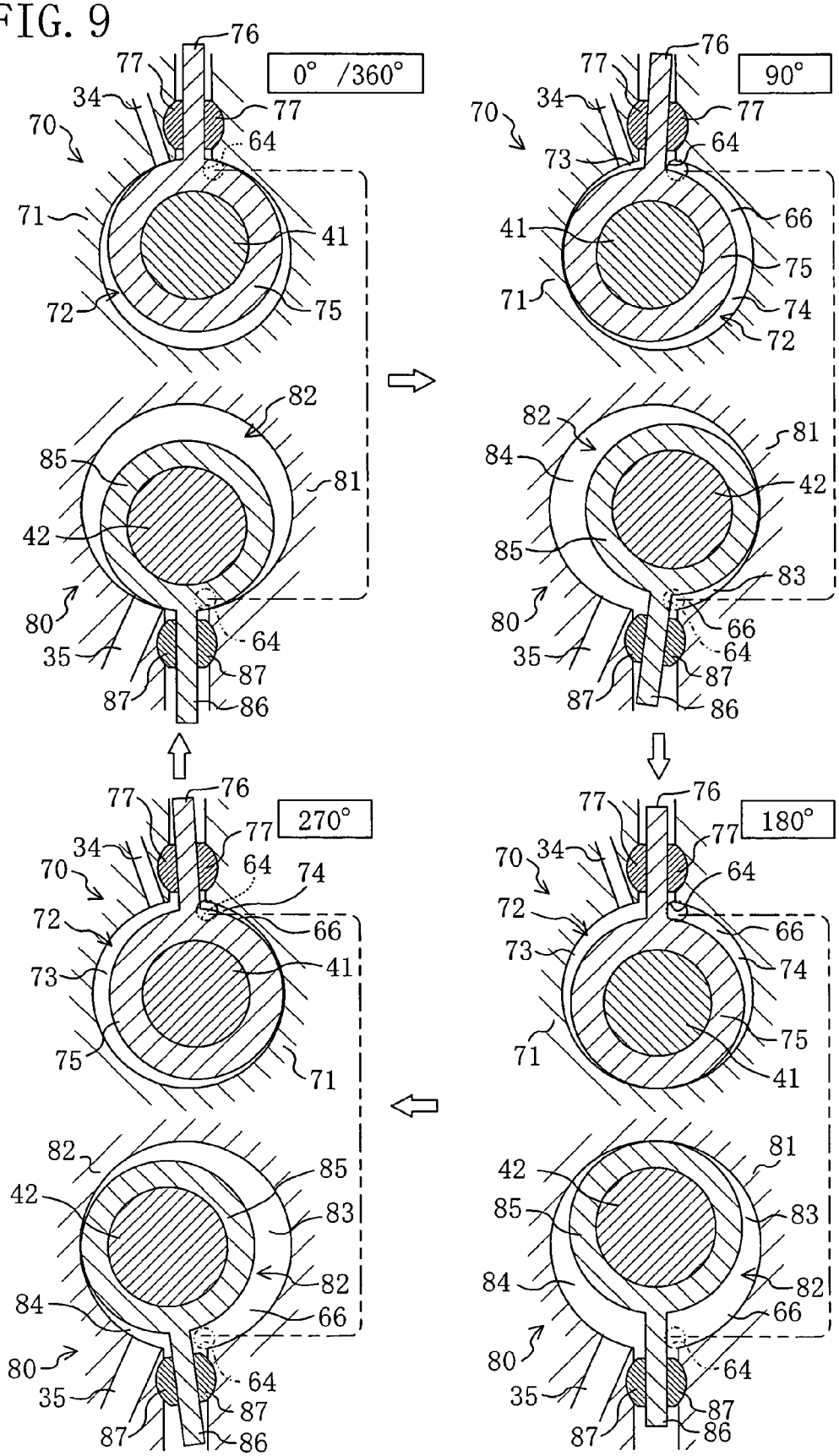
FIG. 9 is a major-section-enlarged diagram which illustrates the states of each rotary mechanism part for every shaft rotational angle of 90° in an expansion mechanism part of a second embodiment of the present invention.

As shown in FIG. 9, in the expansion mechanism part (60) of the present embodiment, the second cylinder (81) is in a reversed postural position with respect to the first cylinder (71). In other words, the angle of arrangement of the second cylinder (81) with respect to the first cylinder (71) is 180°. In addition, in the shaft (40) of the present embodiment, the eccentric direction of the first greater diameter eccentric part (41) and the eccentric direction of the second greater diameter eccentric part (42) differ from each other by 180°. In other words, in the shaft (40) of the present embodiment, the eccentric direction of the first greater diameter eccentric part (41) and the eccentric direction of the second greater diameter eccentric part (42) are at equiangular intervals.

Accordingly, also in the present variational example, the timing at which the first blade (76) reaches its most withdrawn position relative to the direction of the outer periphery of the first cylinder (71) is in synchronization with the timing at which the second blade (86) reaches its most withdrawn position relative to the direction of the outer periphery of the second cylinder (81). In addition, also in the present embodiment, the first low-pressure chamber (74) of the first rotary mechanism part (70) is in fluid communication by way of the communicating passage (64) with the second high-pressure chamber (83) of the second rotary mechanism part (80).

Here, in the rotary mechanism part (70, 80), the internal pressure of the high-pressure chamber (73, 83) is higher than the internal pressure of the low-pressure chamber (74, 84), and a force resulting from this pressure difference acts on the greater diameter eccentric part (41, 42) of the shaft (40). And, in the present embodiment, a first force which acts on the first greater diameter eccentric part (41) due to the difference in internal pressure between the first high-pressure chamber (73) and the first low-pressure chamber (74), and a second force which acts on the second greater diameter eccentric part (42) due to the difference in internal pressure between the second high-pressure chamber (83) and the second low-pressure chamber (84) are opposite in direction of action. Consequently, these two forces applied onto the shaft (40) offset each other. This significantly reduces radial loads acting on the shaft (40). Accordingly, the present embodiment reduces frictional loss between the shaft (40) and its bearing, thereby making it possible to increase the efficiency of the expansion mechanism part (60).

Third Embodiment of the Invention

A third embodiment of the present invention is described. The present embodiment results from modification of the configuration of the expansion mechanism part (60) of the first embodiment. More specifically, whereas the expansion mechanism part (60) of the first embodiment is formed by a fluid machine of the swinging piston type, the expansion mechanism part (60) of the present embodiment is formed by a fluid machine of the rolling piston type. Here, the difference between the first embodiment and the present embodiment as regards the configuration of the expansion mechanism part (60) is described.

Figure 10:
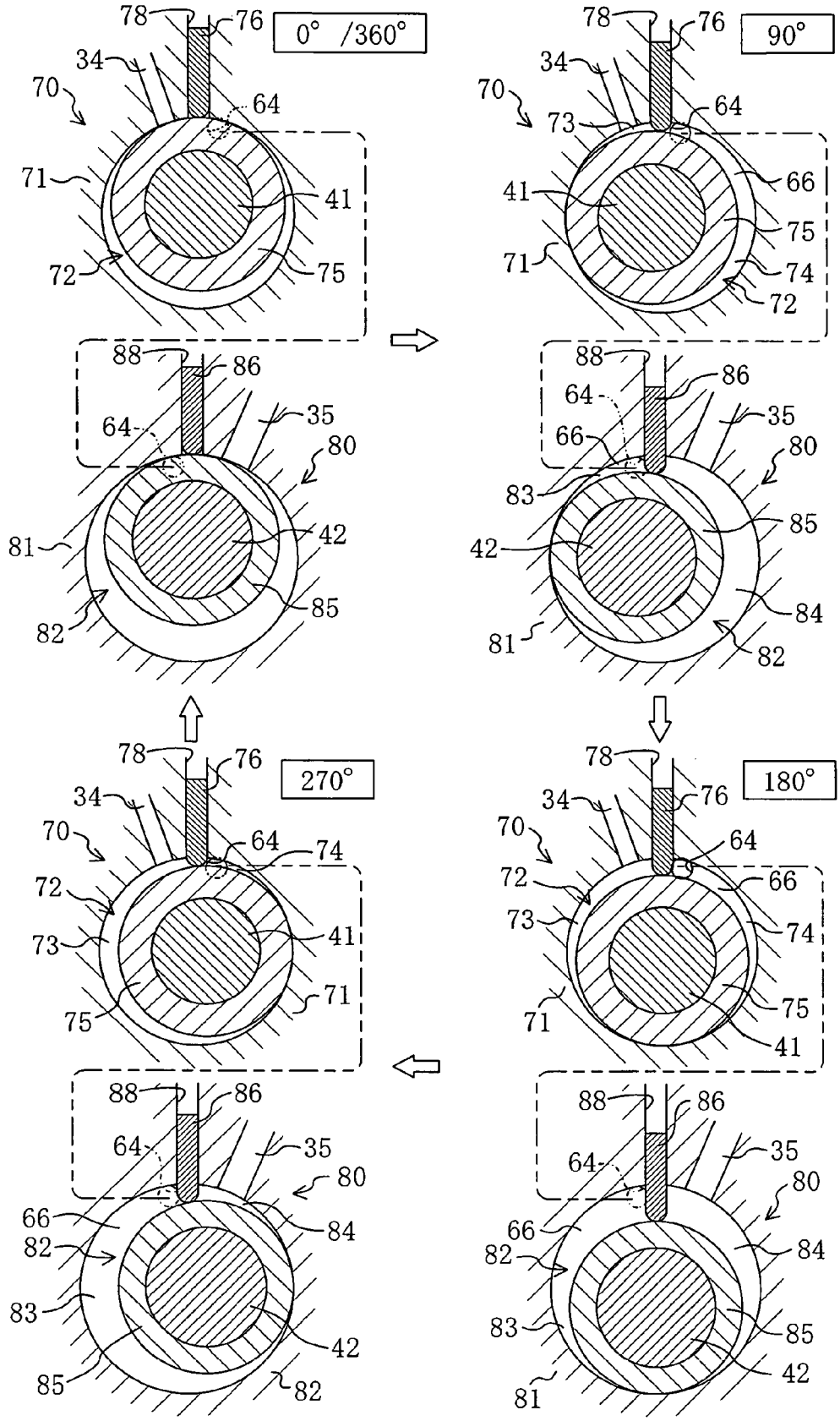
FIG. 10 is a major-section-enlarged diagram which illustrates the states of each rotary mechanism part for every shaft rotational angle of 90° in an expansion mechanism part of a third embodiment of the present invention.

As shown in FIG. 10, in the rotary mechanism part (70, 80) of the present embodiment, the blade (76, 86) is formed as a separate body from the piston (75, 85). In other words, the piston (75, 85) of the present embodiment is shaped like a simple circular ring or cylinder. In addition, the cylinder (71, 81) of the present embodiment is provided with a respective blade groove (78, 88).

In the rotary mechanism part (70, 80), the blade (76, 86) is mounted such that it can freely advance or retreat along the blade groove (78, 88) of the cylinder (71, 81). In addition, the blade (76, 86) is biased by a spring (not shown) such that its tip (lower end in FIG. 10) is pressed against the outer peripheral surface of the piston (75, 85). As sequentially shown in FIG. 10, even when the piston (75, 85) travels within the cylinder (71, 81), the blade (76, 86) goes up and down along the blade groove (78, 88) with its tip remaining in contact with the piston (75, 85). And, by the tip of the blade (76, 86) being pressed against the circumferential surface of the piston (75, 85), the fluid chamber (72, 82) is divided into the high-pressure chamber (73, 83) of high-pressure side and the low-pressure chamber (74, 84) of low-pressure side.

Fourth Embodiment of the Invention

A fourth embodiment of the present invention is described. The present embodiment results from modification of the configuration of the expansion mechanism part (60) of the first embodiment. Here, the difference between the first embodiment and the present embodiment as regards the configuration of the expansion mechanism part (60) is described.

Figure 11:
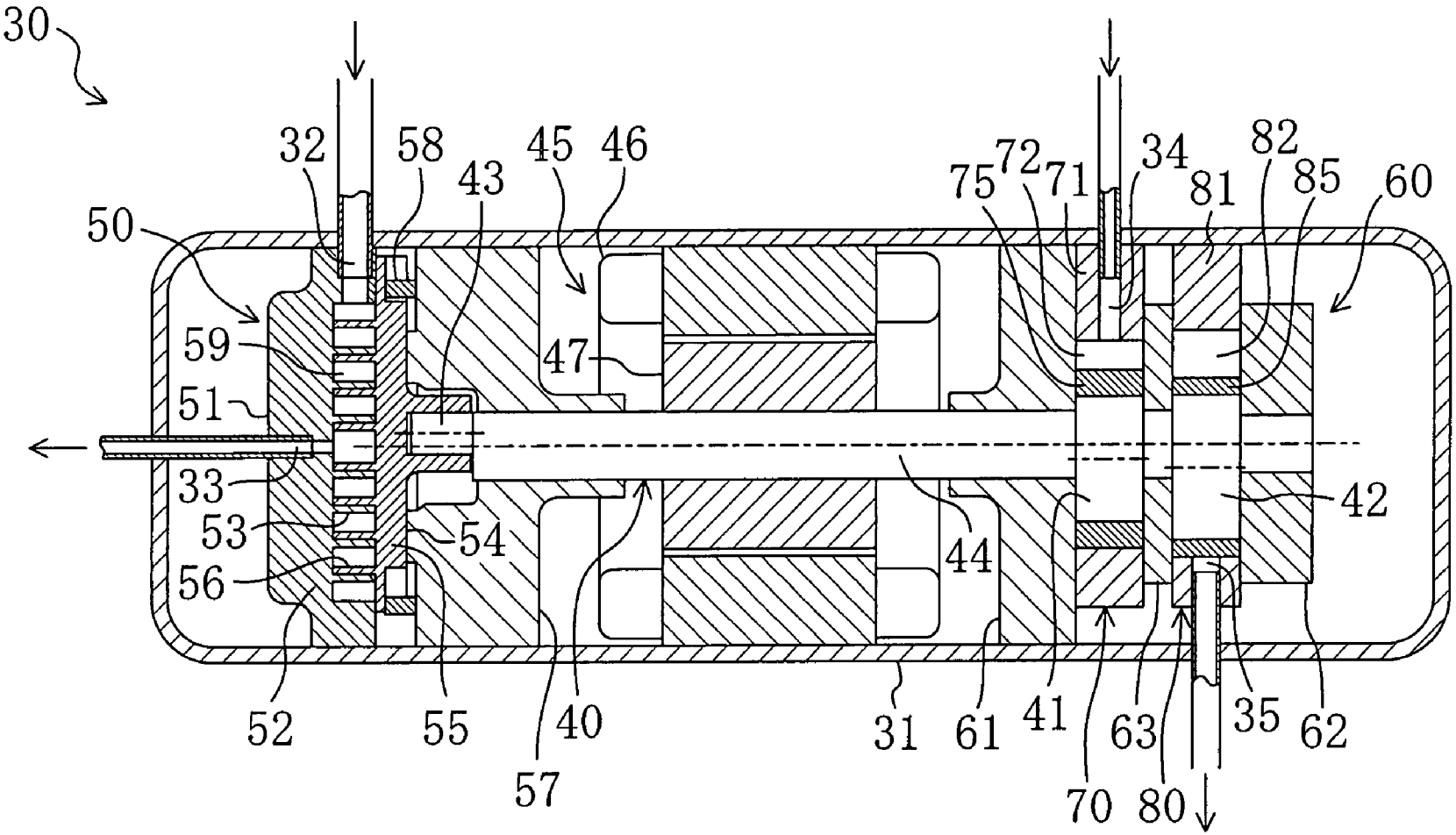
FIG. 11 is a schematic cross sectional diagram of a compression and expansion unit in a fourth embodiment of the present invention.

As shown in FIG. 11, in the expansion mechanism part (60) of the present embodiment, the first rotary mechanism part (70) is disposed nearer to the electric motor (45) than the second rotary mechanism part (80) to the electric motor (45).

More specifically, in the expansion mechanism part (60) of the present embodiment, the front head (61), the first cylinder (71), the intermediate plate (63), the second cylinder (81), and the rear head (62) are stacked in layers in from-left-to-right order in FIG. 11. In this state, the first cylinder (71) is blocked, at its left end surface, by the front head (61). The right end surface of the first cylinder (71) is blocked by the intermediate plate (63). On the other hand, the second cylinder (81) is blocked, at its left end surface, by the intermediate plate (63). The right end surface of the second cylinder (81) is blocked by the rear head (62).

In addition, in the shaft (40) of the present embodiment, of the two greater diameter eccentric parts (41, 42) laterally arranged side by side, one on the left side constitutes the first greater diameter eccentric part (41) while the other on the right side constitutes the second greater diameter eccentric part (42). And, the first piston (75) engages the first greater diameter eccentric part (41) positioned within the first cylinder (71) while on the other hand the second piston (85)

engages the second greater diameter eccentric part (42) positioned within the second cylinder (81).

Fifth Embodiment of the Invention

A fifth embodiment of the present invention is described. Here, the difference between the fourth embodiment and the present embodiment as regards the configuration of the compression and expansion unit (30) is described.

Figure 12:
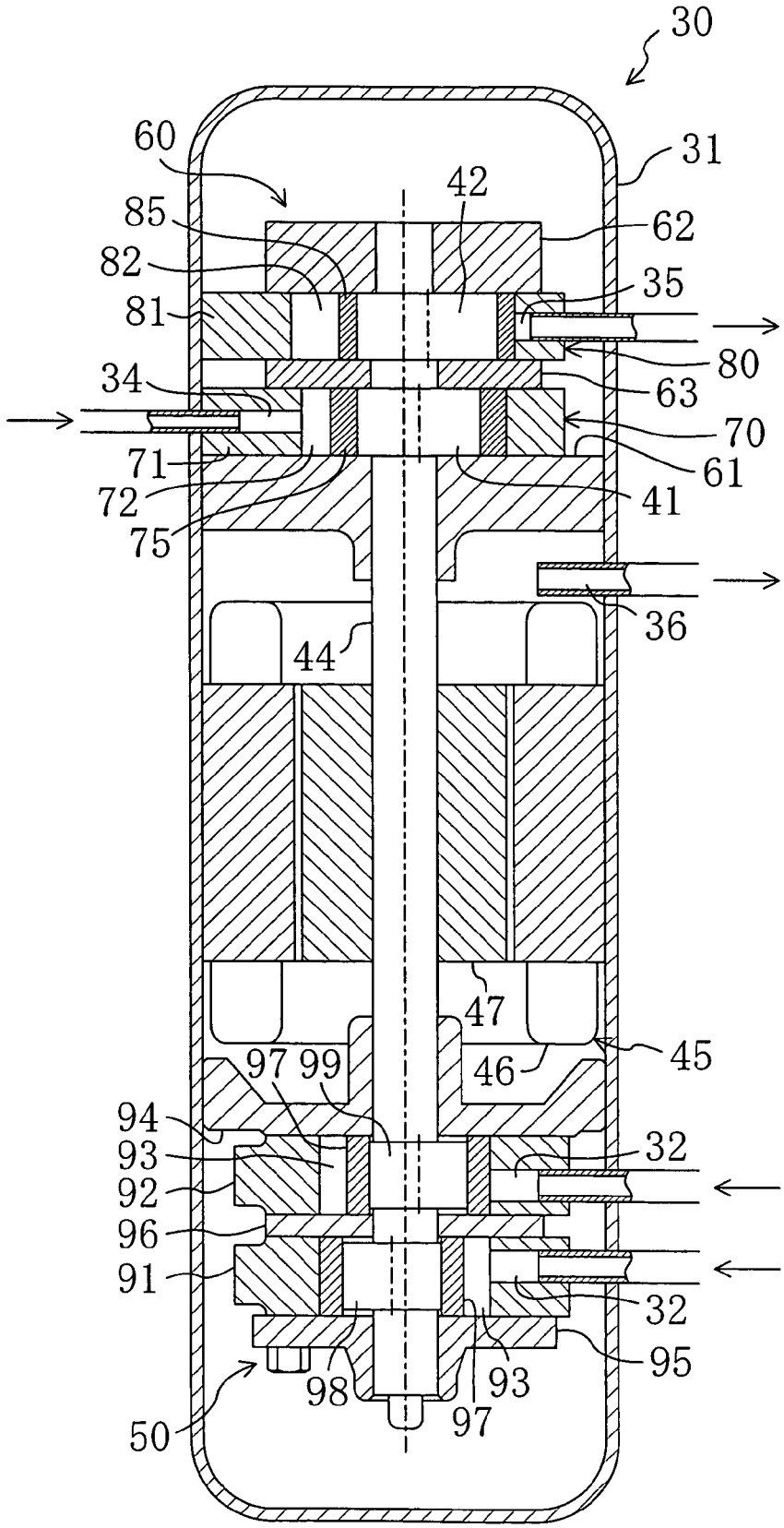
FIG. 12 is a schematic cross sectional diagram of a compression and expansion unit in a fifth embodiment of the present invention.

As shown in FIG. 12, the compression and expansion unit (30) is a fluid machine of the vertical type. More specifically, in this compression and expansion unit (30), the casing (31) is a vertically-elongated, cylinder-shaped, hermetically-closed container. Arranged in sequence in from-bottom-to-top order within the casing (31) are the compression mechanism part (50), the electric motor (45), and the expansion mechanism part (60). In addition, the shaft (40) is disposed in such a postural position that it vertically extends along the longitudinal direction of the casing (31).

The compression mechanism part (50) constitutes a rotary expander of the swinging piston type. The compression mechanism part (50) includes two cylinders (91, 92) and two pistons (97). In the compression mechanism part (50), the rear head (95), the first cylinder (91), the intermediate plate (96), the second cylinder (92), and the front head (94) are stacked in layers in from-bottom-to-top order.

The first and second cylinders (91, 92) each contain therein a respective cylindrical piston (i.e., the first piston (97)). Formed between the outer peripheral surface of the piston (97, 97) and the inner peripheral surface of the cylinder (91, 92) is a compression chamber (93). In addition, although not shown diagrammatically, a flat plate-shaped blade is mounted in projecting manner on the side surface of the piston (97). The blade is supported on the cylinder (91, 92) through a swinging bush.

The first and second cylinders (91, 92) are each provided with a respective suction port (32). Each suction port (32) extends through the cylinder (91, 92) in the radial direction thereof and its terminal end opens to the inner peripheral surface of the cylinder (91, 92).

The front and rear heads (94, 95) are each provided with a respective discharge port. The discharge port of the front head (94) allows the compression chamber (93) within the second cylinder (92) to fluidly communicate with the internal space of the casing (31). The discharge port of the rear head (95) allows the compression chamber (93) within the first cylinder (91) to fluidly communicate with the internal space of the casing (31). In addition, each discharge port is provided, at its terminal end, with a respective discharge valve formed by a reed valve and is placed in the open or closed state by the discharge valve. Note that in FIG. 12 neither the discharge ports nor the discharge valves are shown.

Two lower-side eccentric parts (98, 99) are provided at the bottom of the shaft (40). These two lower-side eccentric parts (98, 99) are formed such that their diameter is greater than that of the main shaft part (44), and the lower of the lower-side eccentric parts (98, 99) constitutes a first lower-side eccentric part (98) while on the other hand the upper of the lower-side eccentric parts (98, 99) constitutes a second lower-side eccentric part (99). The first lower-side eccentric part (98) lies within the first cylinder (91) and engages the piston (97). The second lower-side eccentric part (99) lies within the second cylinder (92) and engages the piston (97). In addition, the first and second lower-side eccentric parts (98, 99) are off-centered in opposite directions relative to the shaft center of the main shaft part (44).

A discharge pipe (36) is attached to the casing (31). This discharge pipe (36) is interposed between the electric motor (45) and the expansion mechanism part (60) and comes into fluid communication with the internal space of the casing (31). Gas refrigerant discharged into the internal space of the casing (31) from the compression mechanism part (50) is fed out from the compression and expansion unit (30) by way of the discharge pipe (36).

The configuration of the expansion mechanism part (60) is the same as its counterpart of the fourth embodiment. However, in association with the change that the compression and expansion unit (30) is of a vertically type, the front head (61), the first cylinder (71), the intermediate plate (63), the second cylinder (81), and the rear head (62) are stacked in layers in from-bottom-to-top order in the expansion mechanism part (60). In other words, in the expansion mechanism part (60), the first rotary mechanism part (70) of small displacement volume underlies the second rotary mechanism part (80) of large displacement volume, in other words the former is disposed nearer to the compression mechanism part (50) than the latter to the compression mechanism part (50).

Effects of the Fifth Embodiment

In the compression and expansion unit (30) of the present embodiment, high-temperature/high-pressure gas refrigerant compressed in the compression mechanism part (50) is passed through the internal space of the casing (31) and flows into the discharge pipe (36). Consequently, refrigerant flowing through the expansion mechanism part (60) is heated to some extent by the refrigerant discharged from the compression mechanism part (50). If refrigerant passing through the expansion mechanism part (60) is heated, this increases the enthalpy of low-pressure refrigerant which is fed out of the expansion mechanism part (60), and the amount of heat that the low-pressure refrigerant absorbs is reduced by just as much as that increase. In addition, if heat is absorbed from the refrigerant compressed in the compression mechanism part (50), this decreases the enthalpy of high-pressure refrigerant which is fed out of the discharge pipe (36), and the amount of heat that the high-pressure refrigerant dissipates is reduced by just as much as that decrease. This causes, in the air conditioner (10) of the present embodiment, a drop in cooling performance due to a decrease in the amount of heat that low-pressure refrigerant absorbs and a drop in heating performance due to a decrease in the amount of heat that high-pressure refrigerant dissipates.

On the contrary, in the expansion mechanism part (60) of the present embodiment, it is arranged such that the second rotary mechanism part (80), through which refrigerant of lower temperature flows, is positioned at the upper side away from the compression mechanism part (50). As a result of such arrangement, in comparison with the case where the second rotary mechanism part (80) is positioned at the lower side near from the compression mechanism part (50), it becomes possible to further reduce the amount of heat which is transferred between the refrigerant passing through the expansion mechanism part (60) and the refrigerant discharged out of the compression mechanism part (50).

Figure 13:
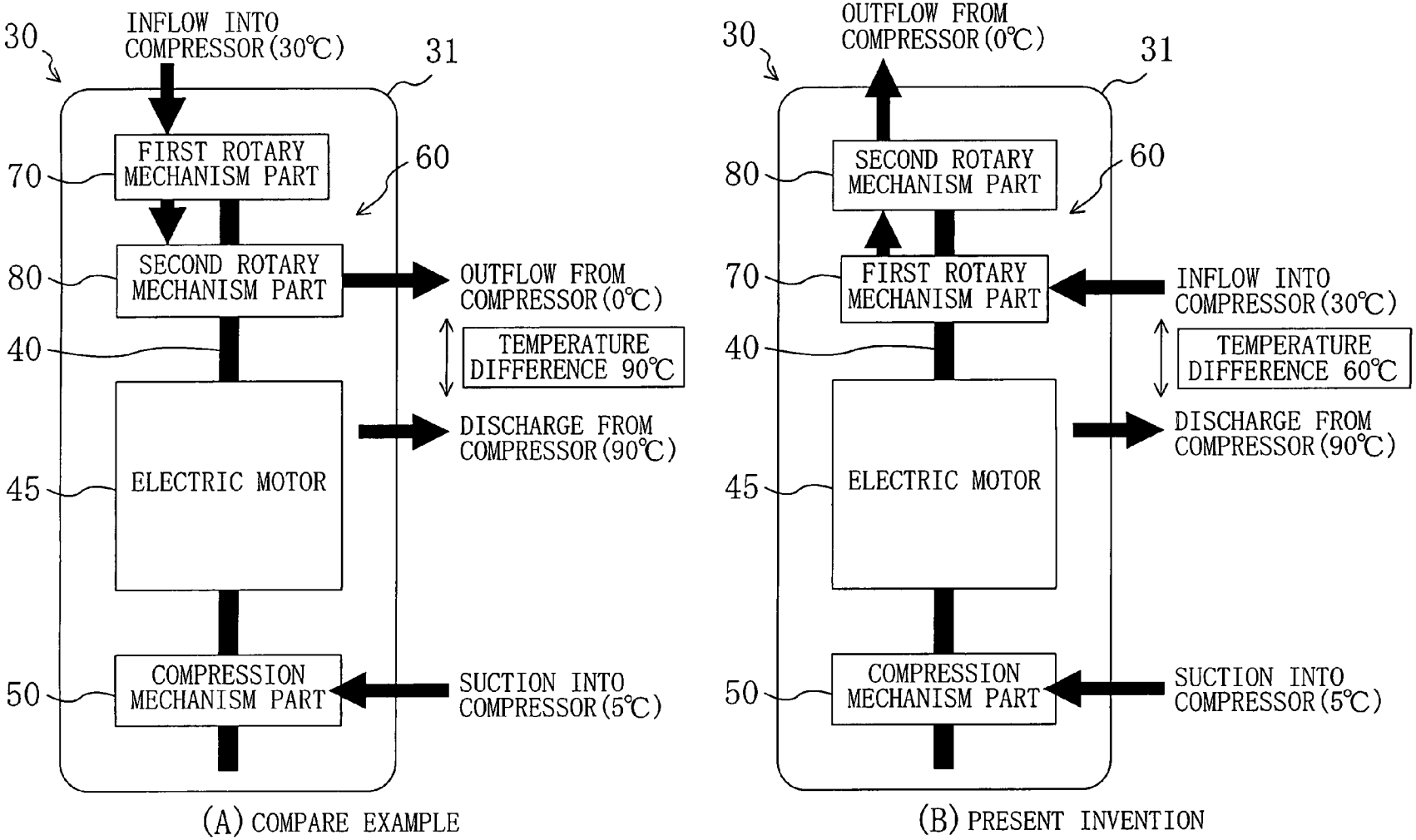
FIG. 13 is comprised of FIG. 13(A) and FIG. 13(B) wherein the former is a schematic constructional diagram of the compression and expansion unit according to the fifth embodiment while the latter is a schematic constructional diagram of a compression and expansion unit according to a compare example.

This is described by making reference to FIG. 13. The description is made by using, as an example, an operating state in which: low-pressure refrigerant of 5° C. is drawn into the compression mechanism part (50); high-pressure refrigerant of 90° C. compressed in the compression mechanism part (50) is discharged out of the discharge pipe (36); high-pressure refrigerant of 30° C. is introduced into the first rotary mechanism part (70) of the expansion mechanism part (60);

and low-pressure refrigerant of 0° C. is fed out of the second rotary mechanism part (80) of the expansion mechanism part (60), as shown in FIG. 13.

As shown in FIG. 13(A), if the second rotary mechanism part (80) is positioned at the lower side near from the compression mechanism part (50), this causes compressed, high-pressure refrigerant of 90° C. to exchange heat with low-pressure refrigerant of 0° C. which is fed out of the second rotary mechanism part (80), and the difference in temperature between these refrigerants which exchange heat with each other amounts to about 90° C. On the other hand, as shown in FIG. 13(B), if the first rotary mechanism part (70) is positioned at the lower side near from the compression mechanism part (50), this causes compressed, high-pressure refrigerant of 90° C. to exchange heat with high-pressure refrigerant of 30° C. which is introduced into the first rotary mechanism part (70), and the difference in temperature between these refrigerants which exchange heat with each other is reduced to about 60° C.

Accordingly, if, as in the present embodiment, the second rotary mechanism part (80) of large displacement volume is disposed in a position away from the compression mechanism part (50), this arrangement makes it possible to reduce the amount of heat input from the refrigerant discharged from the compression mechanism part (50) to the refrigerant in the expansion mechanism part (60). And, in accordance with the present embodiment, it becomes possible to prevent not only a drop in cooling performance but also a drop in heating performance due to the transfer of heat from the refrigerant discharged out of the compression mechanism part (50) to the refrigerant in the expansion mechanism part (60).

Variational Example of the Fifth Invention

Figure 14:
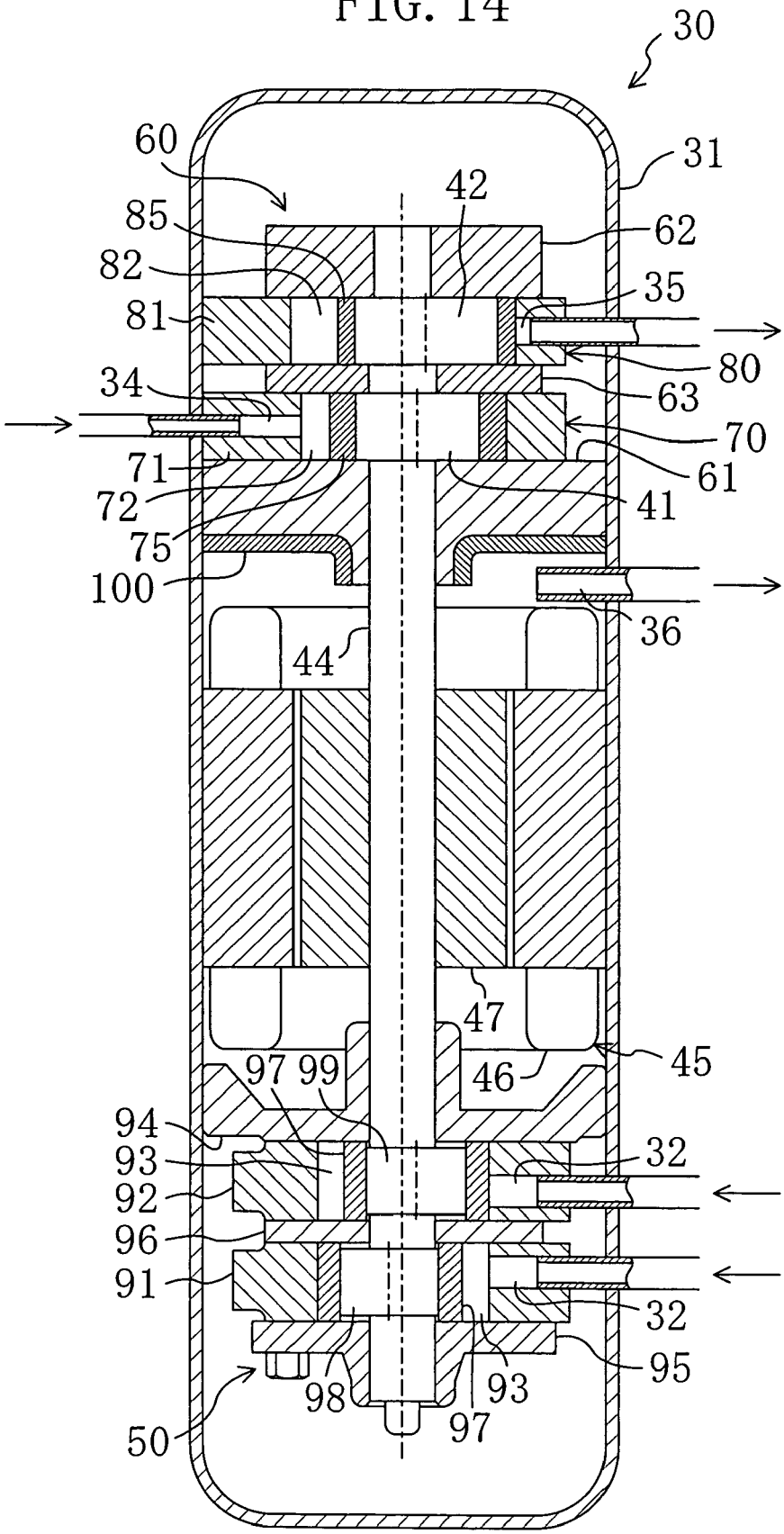
FIG. 14 is a schematic constructional diagram of a compression and expansion unit in a variational example of the fifth embodiment.

As shown in FIG. 14, in the compression and expansion unit (30) of the present embodiment, the expansion mechanism part (60) may be provided with a heat insulating member (100). This heat insulating member (100) is substantially shaped like a circular plate and is disposed so as to come into contact with the lower surface of the front head (61) in the expansion mechanism part (60). In addition, the heat insulating member (100) is formed of a material of relatively low thermal conductivity such as FRP et cetera. By virtue of the provision of the heat insulating member (100), it becomes possible to further reduce the amount of heat input from the refrigerant discharged out of the compression mechanism part (50) to the refrigerant in the expansion mechanism part (60).

Other Embodiments

In each of the above-described embodiments, the expansion mechanism part (60) may be configured as follows.

In the first place, in each of the above-described embodiments, the expansion mechanism part (60) is provided with the two rotary mechanism parts (70, 80). The number of rotary mechanism parts is not limited to two and may be three or more. In this case, the rotary mechanism parts are configured such that they have different displacement volumes from each other and are connected in ascending order of displacement volume.

In addition, in each of the above-described embodiments, the displacement volume of each rotary mechanism parts (70, 80) is made different from the displacement volume of the other rotary mechanism part by making the inside diameter of each cylinder (71, 81) different from the inside diameter of the other cylinder and by making the amount of eccentricity of each greater diameter eccentric part (41, 42) from the amount of eccentricity of the other greater diameter eccentric part. Alternatively, the displacement volume of each rotary mechanism part (79, 80) may be made different from the displacement volume of the other rotary mechanism part by making the height of each cylinder (71, 81) different from the height of the other cylinder and by making the height of each piston (75, 85) from the height of the other piston. Furthermore, the displacement volume of each rotary mechanism part (79, 80) may be made different from the displacement volume of the other rotary mechanism part by making the inside diameter of each cylinder (71, 81), the amount of eccentricity of each greater diameter eccentric part (41, 42), the height of each cylinder (71, 81), and the height of each piston (75, 85) different from the inside diameter of the other cylinder, the amount of eccentricity of the other greater diameter eccentric part, the height of the other cylinder, and the height of the other piston, respectively.

Additionally, in each of the above-described embodiments, the first piston (75) and the second piston (85) are formed such that they have the same outside diameter; however, it does not matter if they differ from each other in outside diameter. In other words, there is no need for the first and second pistons (75, 85) to have the same outside diameter as long as the displacement volume of the second rotary mechanism part (80) exceeds the displacement volume of the first rotary mechanism part (70), and it does not matter if one of the first and second pistons (75, 85) has a greater outside diameter than that of the other.

INDUSTRIAL APPLICABILITY

As has been described above, the present invention is useful with rotary type expanders which drive a rotating shaft by fluid expansion, and with fluid machines provided with such a rotary type expander.

The invention claimed is:

1. A rotary type expander comprising:

a plurality of rotary mechanism parts, each rotary mechanism part including a single cylinder both ends of which are closed, a single piston for forming a fluid chamber within the cylinder, and a single blade for dividing the fluid chamber into a high-pressure chamber of high-pressure side and a low-pressure chamber of low-pressure side; and a single rotating shaft which is provided with eccentric parts for engagement with the piston, the eccentric parts being the same in number as the plurality of rotary mechanism parts;

wherein:

the plural rotary mechanism parts have different displacement volumes from each other and are connected in series in ascending order of their displacement volumes;

in a former-stage-side one of the rotary mechanism parts and a latter-stage-side one of the rotary mechanism parts which are fluidly connected together, fluid flows into the high-pressure chamber of the latter-stage-side rotary mechanism part from the low-pressure chamber of the former-stage-side rotary mechanism part, while the blades of the plural rotary mechanism parts reach their respective most withdrawn positions relative to the direction of the outer periphery of the cylinder substantially simultaneously relative to a particular rotational angle of the rotating shaft.

2. A rotary type expander comprising:

a plurality of rotary mechanism parts, each rotary mechanism part including a single cylinder both ends of which are closed, a single piston for forming a fluid chamber within the cylinder, and a single blade for dividing the fluid chamber into a high-pressure chamber of high-pressure side and a low-pressure chamber of low-pressure side; and a single rotating shaft which is provided with eccentric parts for engagement with the piston, the eccentric parts being the same in number as the plurality of rotary mechanism parts;

wherein:

the plural rotary mechanism parts have different displacement volumes from each other and are connected in series in ascending order of their displacement volumes;

in a former-stage-side one of the rotary mechanism parts and a latter-stage-side one of the rotary mechanism parts which are fluidly connected together, the low-pressure chamber of the former-stage-side rotary mechanism part and the high-pressure chamber of the latter-stage-side rotary mechanism part are in fluid communication with each other, thereby forming a single expansion chamber, while the blades of the plural rotary mechanism parts reach their respective most withdrawn positions relative to the direction of the outer periphery of the cylinder substantially simultaneously relative to a particular rotational angle of the rotating shaft.

3. The rotary type expander of claim 1 or claim 2, wherein:

the eccentric parts of the rotating shaft are so formed as to differ from each other in eccentric direction.

4. The rotary type expander of claim 1 or claim 2, wherein:

the eccentric parts of the rotating shaft are formed such that their respective eccentric directions are at equiangular intervals.

5. The rotary type expander of either claim 1 or claim 2, wherein:

the cylinders of the rotary mechanism parts are stacked in layers with an intermediate plate interposed therebetween;

a communicating passage, for establishing fluid communication between the low-pressure chamber of the former-stage-side rotary mechanism part and the high-pressure chamber of the latter-stage-side rotary mechanism part, is so formed in each intermediate plate as to extend therethrough in a thickness direction; and each cylinder is disposed in a postural position so that the length of the communicating passage is minimized.

6. The rotary type expander of either claim 1 or claim 2, wherein:

the cylinders of the rotary mechanism parts are stacked in layers with an intermediate plate interposed therebetween;

a communicating passage, for establishing fluid communication between the low-pressure chamber of the former-stage-side rotary mechanism part and the high-pressure chamber of the latter-stage-side rotary mechanism part, is so formed in each intermediate plate as to extend therethrough in a thickness direction; and in order that the length of the communicating passage may be minimized, the eccentric parts of the rotating shaft differ from each other in eccentric direction by a predetermined angle.

7. The rotary type expander of claim 1 or claim 2, wherein:

the low-pressure chamber of the former-stage-side rotary mechanism part and the high-pressure chamber of the latter-stage-side rotary mechanism part are in fluid communication with each other by way of a communicating passage; and an intermediate chamber of predetermined volume for reducing pressure variation in the communicating passage is disposed along the communicating passage.

8. The rotary type expander of claim 1 or claim 2, wherein:

carbon dioxide at a pressure above its critical pressure is used as a fluid to be introduced into the high-pressure chamber of the rotary mechanism part of smallest displacement volume.

9. A fluid machine which comprises a rotary type expander as set forth in claim 1, a compressor engaging the rotating shaft of the rotary type expander, and a casing which contains the rotary type expander and the compressor, and in which fluid compressed in the compressor is discharged into the casing, wherein:

the plurality of rotary mechanism parts which are provided in the rotary type expander are arranged such that the greater their displacement volume is, the farther their position is away from the compressor.

10. A fluid machine which comprises a rotary type expander as set forth in claim 2, a compressor engaging the rotating shaft of the rotary type expander, and a casing which contains the rotary type expander and the compressor, and in which fluid compressed in the compressor is discharged into the casing, wherein:

the plurality of rotary mechanism parts which are provided in the rotary type expander are arranged such that the greater their displacement volume is, the farther their position is away from the compressor.

11. The fluid machine of either claim 9 or claim 10, wherein:

the rotary type expander is provided with a heat insulating member that inhibits transfer of heat from fluid in the casing to fluid passing through the rotary type expander.

12. The rotary type expander of claim 1, wherein a rotary mechanism part of smallest displacement volume is provided with an inflow port being in constant fluid communication with the high-pressure chamber of the rotary mechanism part to allow the fluid supplied to the rotary mechanism to flow into the high-pressure chamber, and a rotary mechanism part of largest displacement volume is provided with an outflow port being in constant fluid communication with the low-pressure chamber of the rotary mechanism part to discharge the fluid within the low-pressure chamber outside the rotary type expander.

13. The rotary type expander of claim 2, wherein a rotary mechanism part of smallest displacement volume is provided with an inflow port being in constant fluid communication with the high-pressure chamber of the rotary mechanism part to allow the fluid supplied to the rotary mechanism to flow into the high-pressure chamber, and a rotary mechanism part of largest displacement volume is provided with an outflow port being in constant fluid communication with the low-pressure chamber of the rotary mechanism part to discharge the fluid within the low-pressure chamber outside the rotary type expander.

14. The rotary type expander of claim 1, wherein cylinders of the rotary mechanism parts are arranged so that the blades of the rotary mechanism parts overlap with each other when viewed from an axial direction of the rotating shaft in a state where the blades of the rotary mechanism parts reach their most withdrawn position relative to the direction of the outer periphery of the cylinder, the cylinders of the rotary mechanism parts are stacked in layers with an intermediate plate interposed therebetween, and a communicating passage communicating with the low-pressure chamber of the former-stage-side rotary mechanism part of adjacent two of the rotary mechanism parts, and with the high-pressure chamber of the latter-stage-side rotary mechanism part of the adjacent two of the rotary mechanism parts is formed in the intermediate plate so as to obliquely pass through the intermediate plate with respect to the thickness direction of the intermediate plate.

15. The rotary type expander of claim 2, wherein cylinders of the rotary mechanism parts are arranged so that the blades of the rotary mechanism parts overlap with each other when viewed from an axial direction of the rotating shaft in a state where the blades of the rotary mechanism parts reach their most withdrawn position relative to the direction of the outer periphery of the cylinder, the cylinders of the rotary mechanism parts are stacked in layers with an intermediate plate interposed therebetween, and a communicating passage communicating with the low-pressure chamber of the former-stage-side rotary mechanism part of adjacent two of the rotary mechanism parts, and with the high-pressure chamber of the latter-stage-side rotary mechanism part of the adjacent two of the rotary mechanism parts is formed in the intermediate plate so as to obliquely pass through the intermediate plate with respect to the thickness direction of the intermediate plate.

* * * * *